US007890205B2

(12) United States Patent
Hama et al.

(10) Patent No.: US 7,890,205 B2
(45) Date of Patent: Feb. 15, 2011

(54) TECHNIQUE FOR DETERMINING PROCESSING SEQUENCE OF STEEL PLATES

(75) Inventors: Toshiyuki Hama, Tokyo (JP); Takayuki Yoshizumi, Yamato (JP)

(73) Assignee: International Business Machines Corporation, Armonk, NY (US)

( * ) Notice: Subject to any disclaimer, the term of this patent is extended or adjusted under 35 U.S.C. 154(b) by 406 days.

(21) Appl. No.: 12/038,019

(22) Filed: Feb. 27, 2008

(65) Prior Publication Data

US 2008/0255699 A1 Oct. 16, 2008

(30) Foreign Application Priority Data

Feb. 27, 2007 (JP) ..... 2007-046740

(51) Int. Cl.
*G06F 19/00* (2006.01)

(52) U.S. Cl. ..... 700/149; 700/99

(58) Field of Classification Search ..... 700/149, 700/100, 99, 101, 28–31; 705/1, 8–10; 718/102
See application file for complete search history.

(56) References Cited

U.S. PATENT DOCUMENTS 6,921,452 B2 * 7/2005 Veligdan ..... 156/253
7,634,663 B2 * 12/2009 Shishikura ..... 713/187

FOREIGN PATENT DOCUMENTS

JP PUPA7236955 9/1995
JP PUPA10071411 3/1998

OTHER PUBLICATIONS

"Hot Mill Scheduling," Tokyo Research Laboratory, IBM Japan, Ltd., "http://www.research.ibm.com/trl/projects/optimization/hsm_e.htm," Jan. 31, 2007.

* cited by examiner

*Primary Examiner*—Kidest Bahta
(74) *Attorney, Agent, or Firm*—William Stock; Anne Vachon Dougherty

(57) ABSTRACT

A system for determining a processing sequence of steel plates includes a constraint storage unit for storing positional constraints that define ranges of positions into which each type of steel plate is to be inserted when the steel plates are arranged in the processing sequence; a selecting unit for preferentially selecting, as a position into which a new steel plate is to be inserted in an array of steel plates already arranged in the processing sequence, a position having a larger expectation value of the number of steel plates that can be further inserted into the array of steel plates after the insertion of the new steel plate while satisfying the positional constraints; and an inserting unit for inserting the new steel plate into the selected position and for outputting data indicating the array of steel plates after the insertion.

12 Claims, 20 Drawing Sheets

150

| OPERATION ID | TYPE | WIDTH | THICKNESS | LENGTH | TENSILE STRENGTH | INSPECTION CODE | DELIVERY DATE | CATEGORY OF QUALITY |
|---|---|---|---|---|---|---|---|---|
| 1 | AUTOMOBILE | 926 | 4.05 | 0.45 | 35 | 3415 | 06/01 | D |
| 2 | AUTOMOBILE | 1360 | 3.95 | 0.31 | 34 | 3325 | 06/02 | R |
| ⋮ | ⋮ | ⋮ | ⋮ | ⋮ | ⋮ | ⋮ | ⋮ | ⋮ |
| n | SHIP | 1440 | 4.05 | 0.40 | 34 | 1625 | 06/03 | 0 |
| ⋮ | ⋮ | ⋮ | ⋮ | ⋮ | ⋮ | ⋮ | ⋮ | ⋮ |

FIG. 2

(a)

160

SEQUENCE CONSTRAINT

| ATTRIBUTE | TYPE OF SEQUENCE CONSTRAINT |
|---|---|
| WIDTH | CONSTRAINT ON WIDTH CHANGE |
| THICKNESS | CONSTRAINT ON THICKNESS CHANGE |
| CATEGORY OF QUALITY | CONSTRAINT BETWEEN DIFFICULT MANUFACTURE SLABS |
| CATEGORY OF QUALITY | CONSTRAINT ON RECOVERY SLAB |
| CATEGORY OF QUALITY | CONSTRAINT ON SUPERIOR QUALITY SLAB |

SATISFACTORY FUNCTION P

OBJECTIVE FUNCTION

- LARGER LENGTH OF STEEL SHEETS
- LARGER NUMBER OF DIFFICULT PROCESSING OPERATIONS
- SMALLER NUMBER OF RECOVERY PROCESSING OPERATIONS
- SHORTER TIME OF DELIVERY DELAY (b)

POSITIONAL CONSTRAINT

| STEEL PLATE TYPE | CONTENT OF CONSTRAINT |
|---|---|
| AUTOMOBILE | – 60 |
| SHIP | 60 – |
| PRECISION MACHINE | 30 – 60 |
| ⋮ | ⋮ |

FIG. 3

TECHNIQUE FOR DETERMINING PROCESSING SEQUENCE OF STEEL PLATES

FIELD OF THE INVENTION

The present invention relates to a technique for determining a manufacturing process for a product. In particular, the present invention relates to a technique for determining a sequence of processing a plurality of steel plates that are to be processed sequentially.

BACKGROUND OF THE INVENTION

Steel plants produce steel sheets of various thicknesses and dimensions through hot rolling processes. In the hot rolling process, a thin steel sheet called a coil is produced from a thick steel plate called a slab by rolling out the slab held from above and below by a set of work rolls of a rolling mill. The surface quality of a coil thus produced depends on the surface condition of the work rolls. In addition, rolling a plurality of thick plates one after another using a certain set of work rolls gradually deteriorates the surface condition of the work rolls. For this reason, the rolling of a steel plate requiring a high quality is preferably done with a set of work rolls while the rolls are still fresh.

Moreover, rolling a steel plate may sometimes leave a groove as wide as the plate on the surface of the work rolls. Accordingly, the groove left on the surface of the work rolls by a narrower steel plate rolled earlier may sometimes leave a flaw on the surface of a wider steel plate that is rolled later. In addition, the specification of rolling equipment or the like limits the difference in thickness between successively rolled two steel plates to a certain range. Furthermore, especially thinner steel plates cannot be successively rolled in large numbers, in order to prevent the deterioration in the durability of work rolls. In this regard, a technique for determining the sequence of rolling steel plates has been used in order to maintain the quality of steel sheets and to improve the productivity while satisfying various constraints as described above. The technique is described in an article entitled "Hot Mill Scheduling," Tokyo Research Laboratory, IBM Japan, Ltd., which can be viewed on the research.ibm.com web site under projects/optimization (31 Jan. 2007).

In the foregoing technique, a method termed as local improvement is used in order to further improve a draft rolling sequence. The local improvement process is performed by firstly introducing an evaluation value indicating the efficiency of processing steel sheets. Here, this evaluation value increases as the number and the total length of steel sheets that can be processed by one set of work rolls increase, or as the number of high-quality steel sheets that can be processed by one set of work rolls increases. Then, a judgment is made as to whether or not the evaluation value increases when another certain steel plate is inserted into an array of steel plates already arranged in a processing sequence. When the evaluation value increases, the certain steel plate is inserted and the processing is performed on the new array of steel plates in the new sequence. The degree of increase of the evaluation value may differ depending on the position into which the certain steel plate is inserted. In this case, the steel plate is inserted into the position providing the highest degree of increase of the evaluation value. All the steel plates to be processed are examined in this insertion process.

When the insertion position is determined only by using the evaluation value in the local improvement process, the processing sequence thus determined is not efficient in some cases. This is because a steel plate inserted at an earlier stage of the local improvement inhibits the constraints from being satisfied by other steel plates to be inserted at later stages, and accordingly makes it difficult to insert the other steel plates at the later stages. For example, assume that there is a constraint that the position of a certain type of steel plate in the processing sequence must be no greater than a certain upper limit number. On this assumption, once a new steel plate of the certain type is inserted into a position near the upper limit number, it becomes difficult to insert another steel plate before the new steel plate. In this way, when the local improvement is performed only by using the evaluation value indicating the degree of processing efficiency, the local improvement may eventually determine the inefficient processing sequence in some cases.

In this regard, an object of the present invention is to provide a system, a method and a program which are capable of solving the above-mentioned problem. This object is achieved by combining the features recited in the independent claims in the scope of claims. In addition, the dependent claims define more advantageous specific examples of the present invention.

SUMMARY OF THE INVENTION

A first aspect of the present invention for solving the foregoing problems is to provide a system for determining a processing sequence of steel plates. The system includes a constraint storage unit, a selecting unit and an inserting unit. Specifically, the constraint storage unit stores positional constraints that define ranges of positions to which each type of steel plate is to be inserted when the steel plates are arranged in the processing sequence. As a position into which a new steel plate is to be inserted in an array of steel plates already arranged in the processing sequence, the selecting unit preferentially selects a position having a larger expectation value of the number of steel plates that can be further inserted into the array of steel plates after the insertion of the new steel plate while satisfying the positional constraints. Then, the inserting unit inserts the new steel plate into the selected position and outputs data indicating the array of steel plates after the insertion. In addition, provided are a program for allowing an information processing apparatus to function as the system and a method of determining a processing sequence of steel plates by using the system.

Note that the outline of the present invention mentioned above is not an enumerated list including all of the necessary features of the present invention, and any sub-combination of these features may be included in the present invention.

BRIEF DESCRIPTION OF THE DRAWINGS

For a more complete understanding of the present invention and the advantage thereof, reference is now made to the following description taken in conjunction with the accompanying drawings.

FIG. 2 shows an example of a data structure of an attribute storage unit 150.

FIG. 3 shows an example of a data structure of a problem storage unit 160.

DETAILED DESCRIPTION OF THE PREFERRED EMBODIMENTS

The present invention will be described below by using an embodiment, although the present invention recited in the scope of claims is not limited to the embodiment. Moreover, all of the combinations described in the embodiment are not indispensable for solving means of the present invention.

Figure 1:
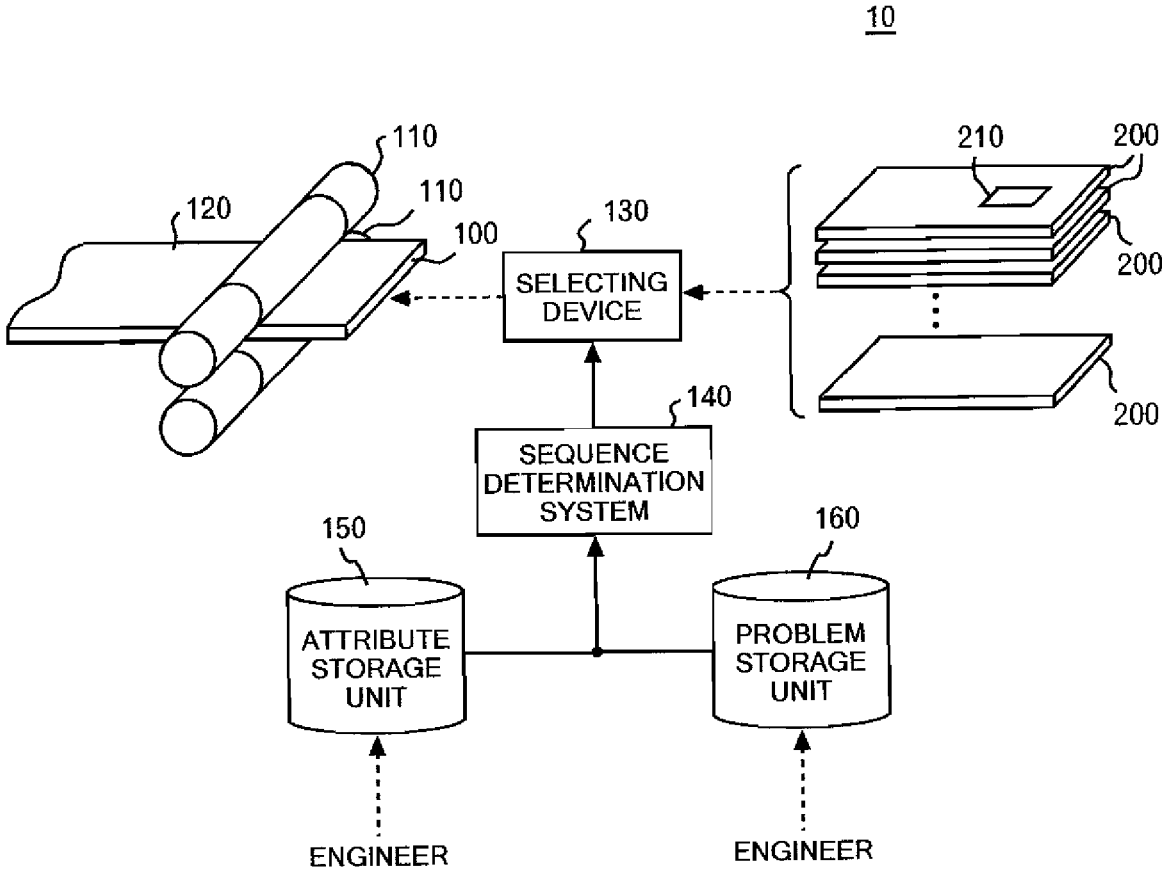
FIG. 1 shows an entire structure of a steel plate processing apparatus 10.

FIG. 1 shows an entire structure of a steel plate processing apparatus 10. The steel plate processing apparatus 10 is an apparatus that produces a plurality of steel sheets by sequentially processing a plurality of steel plates in response to the instruction of a user. The steel plate processing apparatus 10 includes work rolls 110, a selection device 130, a sequence determination system 140, an attribute storage unit 150 and a problem storage unit 160. The work rolls 110 produce a thin sheet 200 by processing a thick plate 100 in a way that work rolls 110 roll the thick plate 100 therethrough while holding it from above and below. The selection device 130 sequentially selects a thick plate 100 among a plurality of thick plates 200 according to a sequence determined by the sequence determination system 140. The thick plate 100 thus selected is then subjected to the rolling process by the work rolls 110.

Each of the plurality of processing operations of rolling the plurality of thick plates 200 has a plurality of attributes. Examples of these attributes are the thickness, the width and the surface quality of a resultant steel sheet having passed through the rolling process (hereinafter simply referred to as "post-rolling"). An attribute value of each attribute may be written in, for example, an attribute label 210 attached to the thick plate 200. At the same time, in the attribute storage unit 150, the attribute values of the respective attributes are recorded in association with a corresponding one of the plurality of processing operations. Moreover, sequence constraints are defined between each pair of the different processing operations, and the sequence constraints thus defined are based on the attributes that each of the relevant processing operations has. The problem storage unit 160 stores the sequence constraints therein.

Moreover, the problem storage unit 160 stores a function for calculating an index value indicating the efficiency of steel plate processing. This function is used as an objective function for finding out the index to be maximized when the sequence of the processing operations is determined. The sequence determination system 140 arranges the plurality of processing operations in a sequence satisfying the sequence constraints stored in the problem storage unit 160, and maximizing the value of the objective function. The sequence determination system 140 outputs the sequence of the processing operations to the selection device 130.

FIG. 2 shows an example of a data structure of the attribute storage unit 150. The attribute storage unit 150 plays a role as a candidate storage unit according to the present invention, and stores various attributes of a processing operation for rolling each of a base number of steel plates predetermined as candidates to be processed. More specifically, the attribute storage unit 150 stores identification information on each processing operation (operation ID) and the attribute value of each of the attributes of each processing operation, while associating the process IDs and the attribute values with the corresponding one of the plurality of processing operations. Attributes of each processing operation include attributes of a post-rolling steel sheet. Examples of such attributes are the type, the width, the thickness, the length and the tensile strength of the post-rolling steel sheet. The thickness of the steel sheet is an example of the second attribute of the present invention, and its attribute value is indicated by the post-rolling thickness of a steel sheet rolled in each corresponding processing operation. The width of the steel sheet is an example of the third attribute of the present invention, and its attribute value is indicated by the post-rolling width of a steel sheet rolled in each corresponding processing operation.

Moreover, the type of the steel sheet indicates intended end-usage of the post-rolling steel sheet. In the example shown in FIG. 2, steel plates 1 and 2 are used for components of automobiles after being rolled through the rolling process. A steel plate n is used for a component of a ship. The other end-usage varies in a wide range such as other types of transportation equipment and precision machines. The quality required for a steel plate varies depending on its usage in some cases. For example, a very high surface quality is required for a steel sheet that is to form the exterior of an automobile, since the steel sheet has a strong influence on the design of the automobile. In this case, it is desirable to roll this steel plate under conditions in which the surface temperatures of the work rolls 110 are sufficiently high and in which the surface conditions of the work rolls 110 do not deteriorate very much. Managing the types of steel plates in the attribute storage unit 150 allows appropriate determinations to be made as to which position for each steel plate when the steel plates are being arranged in the processing order.

In addition, the attributes of the processing operation may include the inspection code used for the inspection of a post-rolling steel sheet, the delivery date of the steel sheet, and the category of quality that the processing operation has to meet. The category of quality is an example of the first attribute, and is indicated by using, as the attribute value, each of the corresponding processing operations that include: a difficult processing operation (D), a recovery processing operation (R), a superior quality processing operation (S) and any other type of processing operation (O). To be more precise, the difficult processing operation (D) impairs the durability of the work rolls 110. The recovery processing operation (R) recovers the durability of the work rolls 110. The superior quality processing operation (S) has to produce a steel sheet with a superior quality to a predetermined standard quality. Note that it is not necessary to store the category of quality itself in the attribute storage unit 150, and that the category of quality may be determined according to other attributes such as the thickness, the tensile strength and the inspection code of a steel sheet.

FIGS. 3A and 3B show an example of a data structure of the problem storage unit 160. The problem storage unit 160 plays a role as a constraint storage unit according to the present invention, and stores sequence constraints and positional constraints. The sequence constraints each indicate an order of arranging processing operations in each of which a steel plate is to be processed, and the positional constraints each define a range to which each type of steel plate is to be arranged when steel plates are arranged in a processing sequence. Firstly, the sequence constraint will be explained by referring to FIG. 3A. The sequence constraint is a constraint indicating an order determined between each pair of the different processing operations and based on each of the attributes. For instance, the problem storage unit 160 stores a constraint on width change as a third sequence constraint based on the third attribute. This constraint on width change is a constraint that the width of a steel plate rolled in the processing operation arranged later in the sequence should be narrower than the width of a steel plate rolled in the processing operation arranged earlier in the sequence. With this constraint, it is possible to prevent a groove left on the work rolls 110 from leaving a flaw on the surface of a subsequently-processed steel sheet.

In addition, the problem storage unit 160 stores a constraint on thickness change as a second sequence constraint based on the second attribute. This constraint on thickness change is a constraint that the value of difference in thickness between two steel plates to be rolled in two successive processing operations should be within a predetermined range. With this constraint, it is possible to reduce the time required for the thickness adjustment, thereby allowing a plurality of successive processing operations to be performed speedily. Further, the problem storage unit 160 stores a constraint between difficult manufacture slabs, a constraint on a recovery slab, and a constraint on a superior quality slab. The constraint between difficult manufacture slabs is a constraint that prohibits successively performing greater than or equal to a predetermined number of difficult processing operations. In addition, the constraint on a recovery slab is a constraint that a recovery processing operation must be performed between two difficult processing operations. The constraint on a superior quality slab is a constraint that a processing operation for a superior quality steel sheet should be performed at a predetermined block. As for the block, descriptions will be given later by referring to FIG. 4.

Note that, although FIG. 3 shows the name indicating each of the constraints for convenience of explanation, the problem storage unit 160 may store in practice a function or the like for judging whether or not the sequence of the processing operations satisfies each of the constraints. Furthermore, the problem storage unit 160 stores the satisfaction probability p that a new steel plate satisfies these sequence constraints when being inserted into a position randomly selected from the already-arranged processing sequence of steel plates. This probability p may be one inputted by a user, or may be one figured out by using the sequence of steel plates actually arranged in the past. However, the probability p that a new steel plate satisfies these sequence constraints when being inserted into a position randomly selected from the already-arranged processing sequence of steel plates takes usually a very small value such as 1% or less, because the various sequence constraints must be satisfied as described above.

Secondly, the positional constraints will be described by referring to FIG. 3B. The problem storage unit 160 stores ranges to each of which a type of steel plate is to be arranged when the steel plates are arranged in the processing sequence, while associating the ranges with the types of steel plates. For instance, the problem storage unit 160 may store both constraints on the upper limit value and the lower limit value or a constraint on any one of these values. The constraint on the upper limit value is an example of the positional constraints, and indicates the upper limit value of positions in which each type of steel plates is to be arranged. According to the positional constraints shown in FIG. 3B, a steel plate to be used for an automobile is rolled in a position within a range up to the 60th steel plate after the work rolls 110 start rolling, and is not provided with the lower limit value, in particular. On the other hand, a steel plate to be used for a ship is rolled in a position within a range of the 60th and following steel plates after the work rolls 110 start rolling, and is not provided with the upper limit value, in particular. Moreover, a steel plate to be used for a precision machine is rolled in a position within a range of the 30th to 60th steel plates after the work rolls 110 start rolling. By providing the positional constraints in this way, the surface qualities of post-rolling steel sheets can be appropriately controlled for each type of end-usage.

Figure 4:
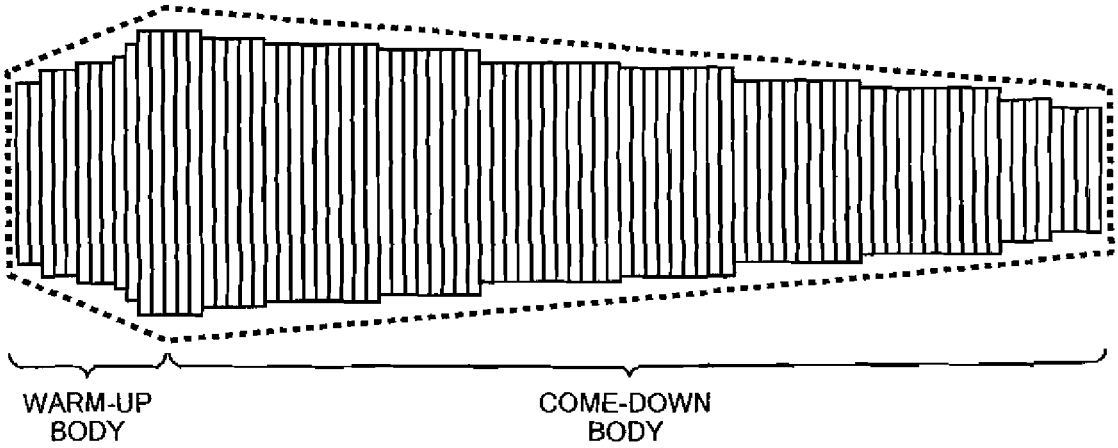
FIG. 4 shows an example of a processing sequence of processing operations.

FIG. 4 shows an example of the sequence of processing operations. Each of rectangular regions shown in FIG. 4 schematically represents a post-rolling steel sheet. The length of each rectangular region in up-and-down directions in FIG. 4 denotes the width of each post-rolling steel sheet. The left-to-right direction in FIG. 4 denotes the lapse of time. For example, during a period (called a warm-up body) just after an exchange of work rolls, a plurality of steel plates are rolled in a sequence so as to gradually increase the widths of the respective post-rolling steel sheets. Thus, it is possible to increase the temperature of work rolls gradually, and to make the work rolls ready for rolling a steel plate for a superior quality steel sheet. Moreover, during a period (called a come-down period) following a time when a certain number of rolling processing operations are completed after the exchange of the work rolls, a plurality of steel plates are rolled in a sequence so as to gradually decrease the widths of the respective post-rolling steel sheets. In this way, it is possible to avoid a flaw left on the surfaces of the steel sheet rolled later.

Figure 5:
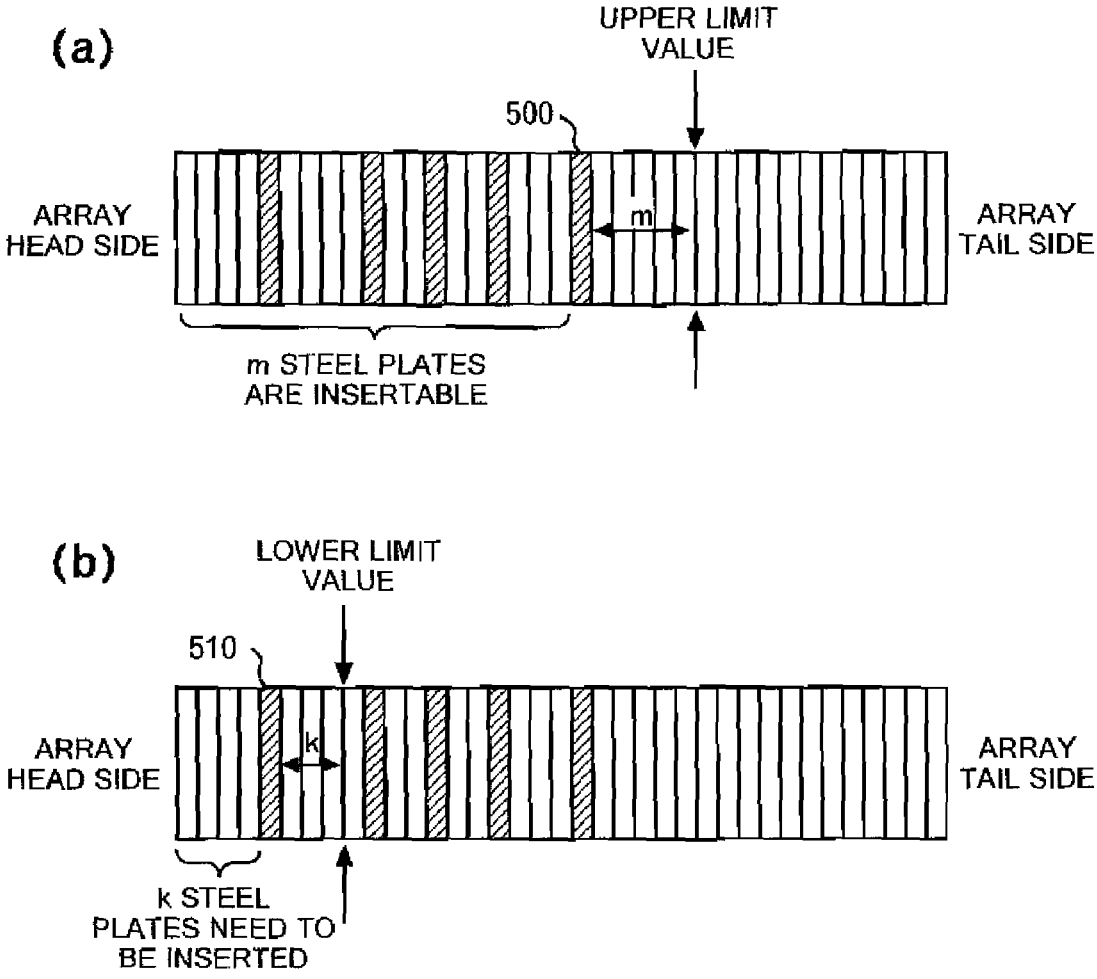
FIGS. 5A and 5B are conceptual diagrams each showing an example of a positional constraint.

When a series of steel plates which are rolled as described above in a period from a time of starting to roll with work rolls to a time of exchanging the work rolls with new ones, a coffin shape is considered as a desirable shape formed by the varying widths of the steel plates arranged in the processing order. The sequence determination system 140 of the present invention aims to maximize the efficiency of steel plate processing, while satisfying the various constraints including the change in the widths of the steel sheets as shown in FIG. 4. Moreover, if candidates of steel plates to be processed remain even when a processing sequence achieving a certain degree of processing efficiency is determined, the sequence determination system 140 is required to further insert another new steel plate into the array of steel plates indicating the processing sequence. Here, it is preferable that the position into which the new steel plate is to be inserted be determined according to whether or not the efficiency of the entire rolling processing increases after the steel plate is inserted into the position. However, such insertable position of the new steel plate is limited to a certain range by the aforementioned positional constraints. Hereinafter, the limitation by the positional constraints is described by referring to FIGS. 5 to 7.

FIGS. 5A and 5B are conceptual diagrams each showing an example of the positional constraints. FIG. 5A shows the constraint on the upper limit value. Here, a steel plate 500 denotes a steel plate arranged in the last position among a certain type of steel plates when steel plates are arranged in a processing sequence. This steel plate type has the constraint on the upper limit value, and the steel plate 500 satisfies this positional constraint. Accordingly, the steel plate 500 is arranged before the upper limit value of this steel plate type. Here, m denotes the difference value between the upper limit value and the position in which the steel plate 500 is arranged. When another steel plate is inserted before the steel plate 500, this difference value is (m−1). Thus, m is the maximum number of steel plates that can be inserted into positions before the steel plate 500 while satisfying the constraint on the upper limit value.

FIG. 5B shows a constraint on the lower limit value. A steel plate 510 denotes a steel plate arranged in the first position among a certain type of steel plates when steel plates are arranged in the processing sequence. This steel plate type has the constraint on the lower limit value, and the steel plate 510 satisfies this positional constraint. Accordingly, the steel plate 510 is arranged before the lower limit value of this steel plate type. On the assumption that this steel plate 510 does not have to satisfy the constraint on the lower limit value in a certain time point while the processing sequence is determined, there is a case where the steel plate 510 is arranged before the lower limit value of this steel plate type. Here, k denotes the difference value between the lower limit value and the position in which the steel plate 510 is arranged in the above case. When another steel plate is inserted before the steel plate 510, the difference value is (k−1). Accordingly, k steel plates have to be inserted into positions before the steel plate 510 in order to satisfy the constraint on the lower limit value.

Here, consider a case where a processing sequence is tentatively determined first, and where then a large number of steel plates are further inserted to the tentative processing sequence. In this case, the tentative processing sequence does not have to satisfy the constraint on the lower limit value at the time of the tentative determination. Moreover, if the constraint on the lower limit value has to be satisfied at the time of the tentative determination, the constraint which is more restrictive than necessary is imposed on the sequence determination, and this results in a reduction of the efficiency of processing an array of steel plates generated under such constraint. For this reason, the sequence determination system 140 tentatively determines the processing sequence while temporarily relaxing the constraint on the lower limit value. Thereafter, the sequence determination system 140 causes the processing sequence to satisfy the constraint on the lower limit value by inserting steel plates. The description of this embodiment will be provided following this procedure.

Figure 6:
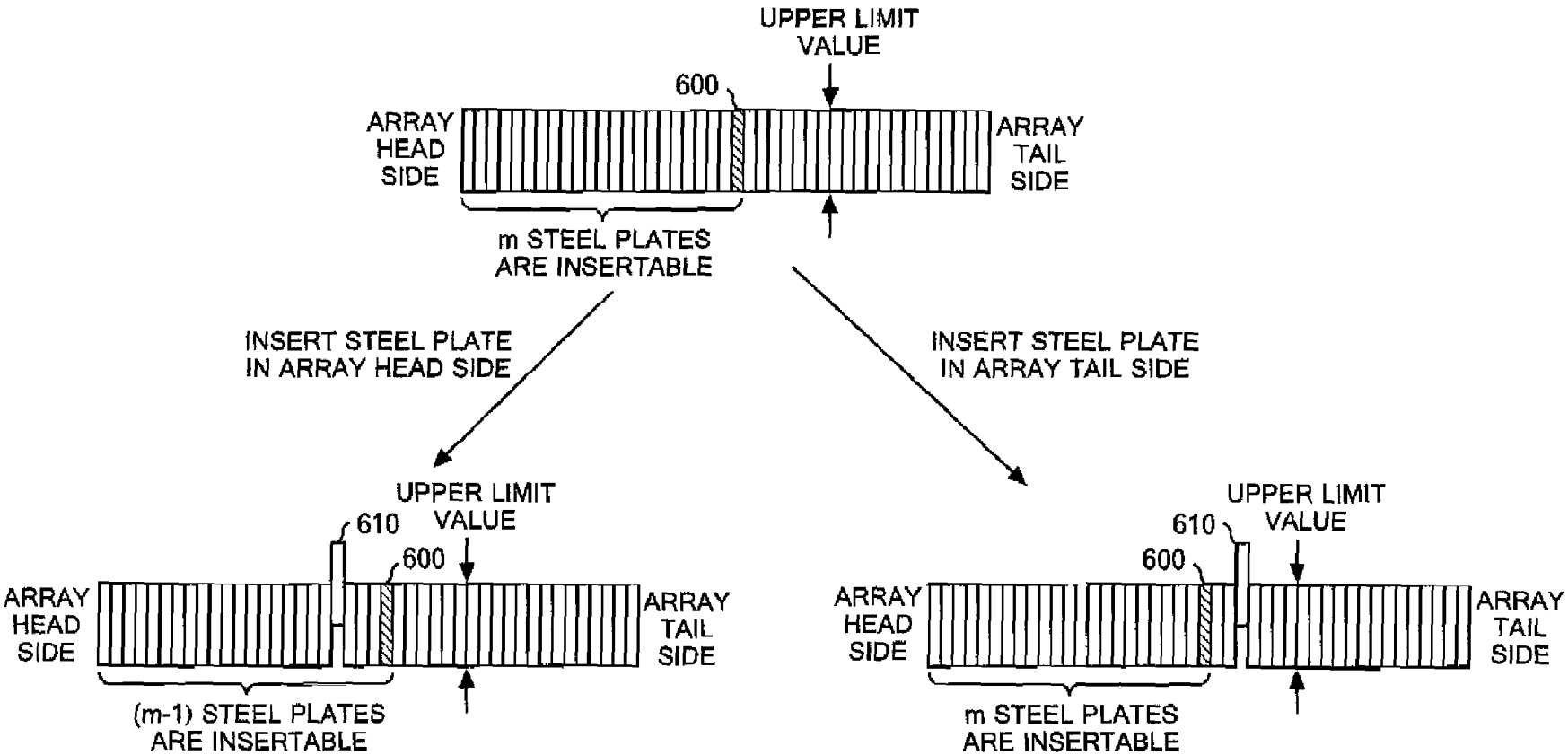
FIG. 6 shows changes of the number of insertable steel plates after a steel plate not restricted by the positional constraints.

FIG. 6 shows changes of the number of steel plates insertable into a processing sequence after a steel plate not restricted by the positional constraint is inserted thereinto. Here, a steel plate 600 denotes a steel plate arranged in the last position among a certain type of steel plates when steel plates are arranged in the processing sequence. In addition, m denotes the difference between the position in which the steel plate 600 is arranged and the upper limit value of this steel plate type. In this state, if a different type of steel plate 610 not restricted by this upper limit value is inserted before the steel plate 600, the difference between the steel plate 600 and the upper limit value decreases to m−1. On the other hand, if the steel plate 610 is inserted after the steel plate 600, the difference between the steel plate 600 and the upper limit value remains as m. In other words, in a case where the different type of steel plate 610 is inserted into the processing sequence with the steel plate 600 arranged in the last position of the certain type of steel plates, the number of positions into which other steel plates can be further inserted is larger when the steel plate 610 is inserted before the steel plate 600, than when the steel plate 610 is inserted after the steel plate 600.

Figure 7:
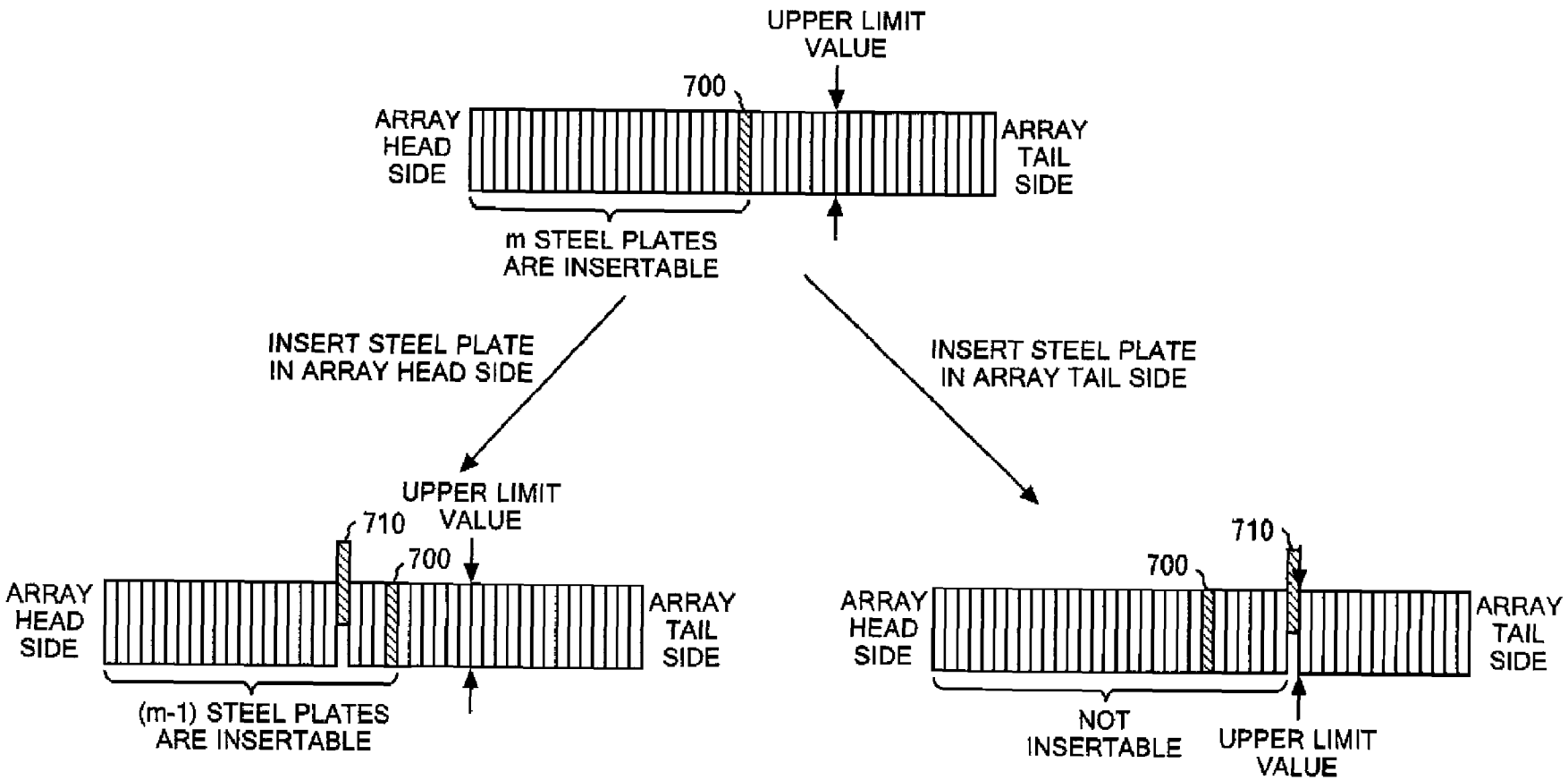
FIG. 7 shows changes of the number of insertable steel plates after a steel plate restricted by the positional constraints.

FIG. 7 shows changes of the number of steel plates insertable into a processing sequence after a steel plate restricted by the positional constraint is inserted thereinto. Here, a steel plate 700 denotes a steel plate arranged in the last position of a certain type of steel plates when steel plates are arranged in the processing sequence. In addition, m denotes the difference between the position in which the steel plate 700 is arranged and the upper limit value of this steel plate type. In this state, if a steel plate 710 of the same type as the steel plate 700 is inserted before the steel plate 700, the difference between the steel plate 700 and the upper limit value decreases to m−1. On the other hand, if the steel plate 710 is inserted after the steel plate 700, the last steel plate of this type is changed from the steel plate 700 to the steel plate 710. Moreover, the number of steel plates insertable into positions before the steel plate 710 is limited by the difference value between the steel plate 710 and the upper limit value. For example, if the position of the inserted steel plate 710 is the same as the upper limit value, it is impossible to insert a steel plate into any position before the steel plate 710 thereafter.

As shown in FIGS. 6 and 7, in a case where a new steel plate is inserted into an array of steel plates already arranged in a processing sequence, the number of insertable steel plates after the insertion largely differs depending on the position and the type of the inserted steel plate. For this reason, an inadequate determination is sometimes made as to the position into which a steel plate is to be inserted, if the determination is made only depending on how high the processing efficiency at the insertion time is. To be more precise, even when the insertion of a steel plate leads to high processing efficiency at the insertion time, this insertion may render the number of insertable steel plates thereafter extremely small, and the resultant processing sequence may have only insufficient processing efficiency. In connection with this, in a process of improving the processing efficiency by sequentially inserting steel plates, the sequence determination system 140 according to this embodiment makes a determination on a position for the insertion not only based on the processing efficiency at the insertion time, but also based on the number of steel plates additionally insertable after the insertion. This determination is made through an operation of a local searching section 840, which will be described later. In this way, the processing efficiency can be further increased. The detailed description thereof will be provided below.

Figure 8:
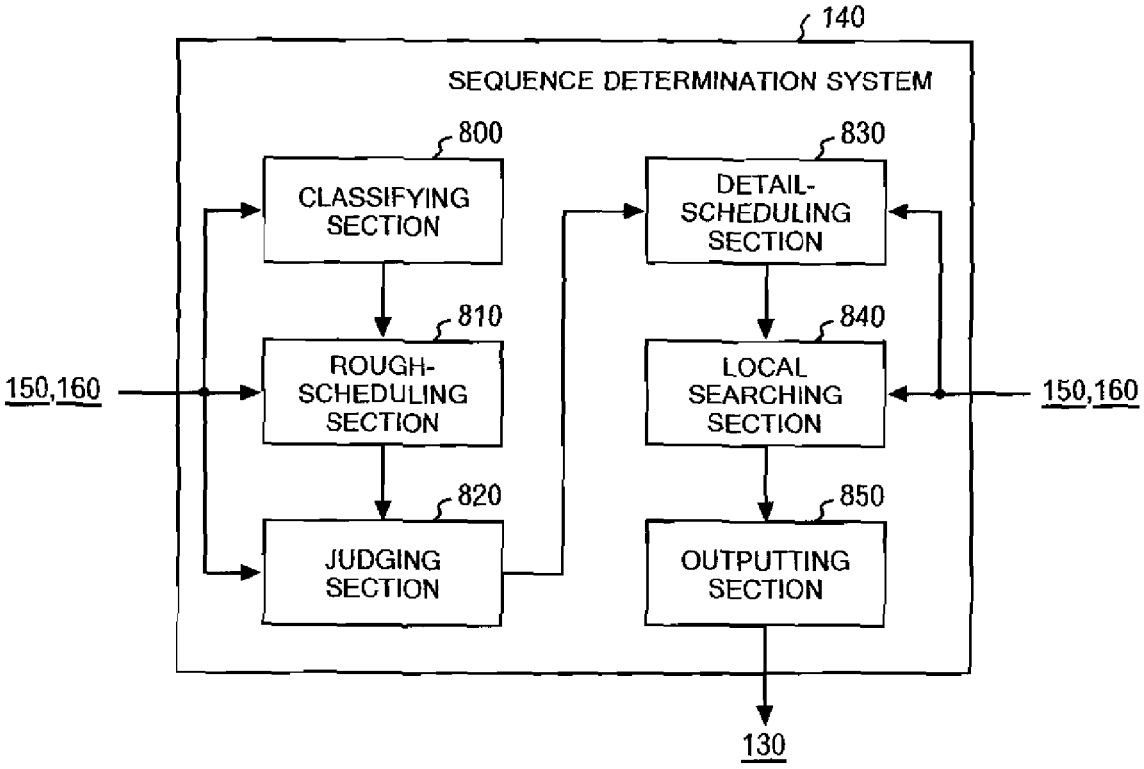
FIG. 8 shows a functional structure of a sequence determination system 140.

FIG. 8 shows a functional structure of the sequence determination system 140. The sequence determination system 140 includes a classifying section 800, a rough-scheduling section 810, a judging section 820, a detail-scheduling section 830, a local searching section 840 and an outputting section 850. The classifying section 800, the rough-scheduling section 810, the judging section 820 and the detail-scheduling section 830 determine a tentative processing sequence of steel plates as illustrated in FIG. 4 in cooperation with each other. Then, the local searching section 840 further improves the processing efficiency while attempting to insert other steel plates into the array of steel plates representing the processing sequence thus determined.

First, for the purpose of classifying a plurality of processing operations into a plurality of clusters, the classifying section 800 sequentially selects at least one of the processing operations as a cluster. At this time, the processing operations are classified into the clusters according to the attribute values of the first attribute. For example, all the processing operations in each cluster have the same attribute value of the first attribute. Moreover, the processing operations in each cluster are arranged in a sequence satisfying the second sequence constraint and the third sequence constraint. For example, all the categories of quality of the processing operations in each cluster are the same, and the processing operations in the cluster are arranged in a sequence satisfying the constraint on width change and the constraint on thickness change.

The rough-scheduling section 810 regards each of the first sequence constraint and the third sequence constraint as a constraint between the plurality of clusters, and arranges the plurality of processing operations in a sequence maximizing the efficiency of steel plate processing. The sequencing of the processing operations may be carried out by solving an integer programming problem. For example, when a period from a time when work rolls 110 start to roll steel plates to a time when the work rolls 110 are exchanged with new ones after sequentially rolling a plurality of steel plates is divided into a plurality of blocks, the problem of determining which cluster of the processing operations to be performed in each of the plurality of blocks may be employed as an integer programming problem. In this case, the rough-scheduling section 810 may solve this integer programming problem. When this integer programming problem is solved, the positional constraints are set as follows, taking into consideration that the local searching section 840 inserts steel plates thereafter. Specifically, the constraint on the upper limit value is set as a constraint that is a little bit more restrictive while the positional constraint on the lower limit value is set as a constraint that is a little bit less restrictive. More precisely, when the positional constraints stored in the problem storage unit 160 have the lower limit value of 30 and the upper limit value of 60, the solution of the integer programming problem is computed under the positional constraints on the less-restrictive lower limit value (for example, 20) obtained by subtracting a certain value from the lower limit value, and on the more-restrictive upper limit value (for example, 40) obtained by subtracting a certain value from the lower limit value. Moreover, the period from a time when work rolls 110 start to roll steel plates to a time when the work rolls 110 are exchanged with new ones after sequentially rolling a plurality of steel plates is referred to as a round. In addition, FIG. 11 shows an example of a plurality of blocks obtained by dividing one round.

Figure 11:
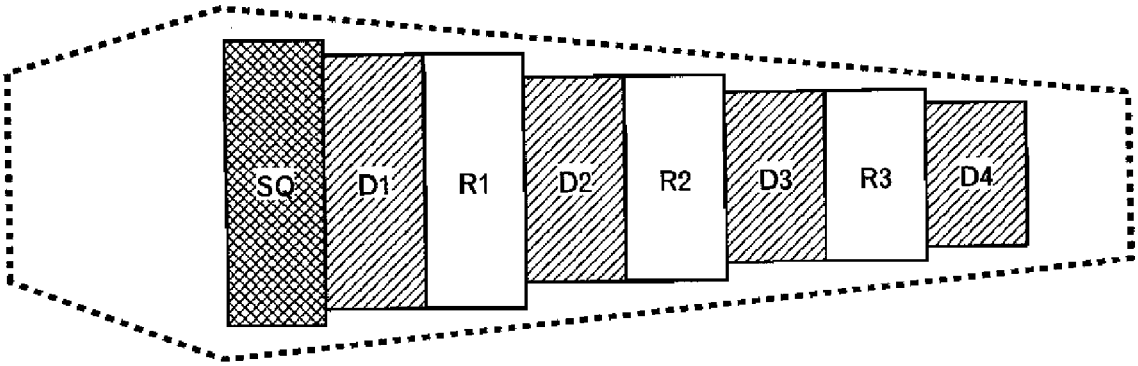
FIG. 11 shows a specific example of a plurality of blocks constituting one round.

FIG. 11 shows the specific example of the plurality of blocks constituting one round. The come-down period of this round is divided into a plurality of blocks each of which is represented as a rectangular in FIG. 11. Each block is represented in association with an identifier. For example, the plurality of blocks consists of a block SQ, a block D1, a block R1, a block D2, a block R2, a block D3, a block R3 and a block D4. In the block SQ, the surface condition of the work rolls 110 is good enough to roll a high quality steel sheet therethrough. When the difficult processing operations are performed in the blocks of D1, D2, D3 and D4, it is inevitable that the recovery processing operations be performed in the blocks of R1, R2 and R3.

Figure 12:
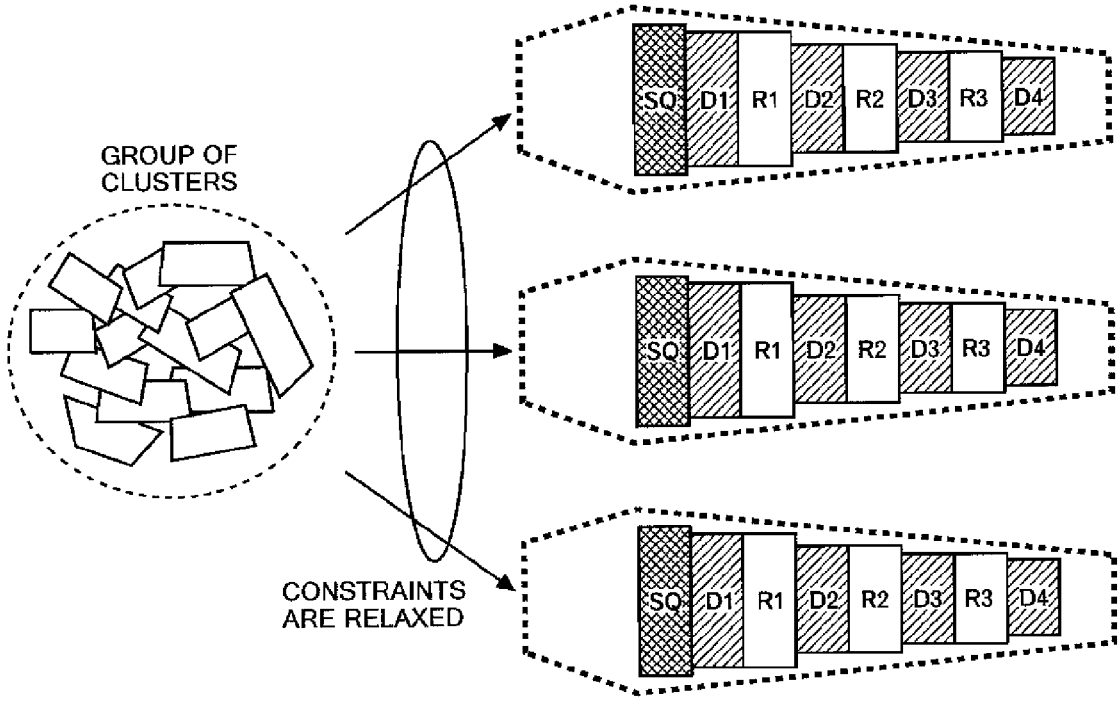
FIG. 12 is a conceptual diagram of a process for assigning a plurality of clusters to a plurality of blocks.

Furthermore, FIG. 12 is a conceptual diagram of a process for assigning a plurality of clusters to a plurality of blocks. The left-hand side of FIG. 12 shows the plurality of clusters classified by the classifying section 800. The rough-scheduling section 810 selects some clusters capable of maximizing the processing efficiency, among all the clusters, and determines which cluster of the processing operations to be performed in which block by using which set of work rolls among a plurality of sets of work rolls. It is not necessary to assign each of all the classified clusters to any one of the blocks. These clusters that have not been assigned are to be assigned in the next occasion together with the other clusters to be classified in the next occasion by the classifying section 800. As just described, it is not necessary to assign all the clusters, and this makes it possible to increase the degree of freedom in the sequence determination. Moreover, a round to which a cluster is to be assigned is not a fixed one, but one selected from a plurality of rounds. This makes it possible to improve the degree of freedom, and to increase the processing efficiency.

Here, the description goes back to FIG. 8. The judging section 820 judges whether or not the second sequence constraint is satisfied between the last processing operation in the array of the first cluster, and the first processing operation in the array of the second cluster arranged next to the first cluster. On condition that the second sequence constraint is not satisfied, the detail-scheduling section 830 searches for another processing operation satisfying the second sequence constraint with the last processing operation in the array of the first cluster, and with the first processing operation in the array of the second cluster. The detail-scheduling section 830, then, arranges the searched-out processing operation (called "the first searched-out processing operation" when necessary) next to the first cluster and before the second cluster.

On condition that the second sequence constraint is satisfied, the local searching section 840 attempts to modify the sequence of the processing operations in order to further improve the processing efficiency. For instance, with respect to each steel plate whose attribute values are already stored in the attribute storage unit 150 and whose position in the processing sequence is not determined yet, the local searching section 840 judges a change in the value of the objective function by inserting the steel plate into the array of steel plates arranged by the rough-scheduling section 810 and the detail-scheduling section 830. For example, the local searching section 840 judges whether the insertion of this steel plate allows the processing sequence to satisfy the sequence constraint and the value of the objective function to increase. When the sequence constraint is satisfied and when the value of the objective function increases, the local searching section 840 inserts this steel plate. The local searching section 840 repeatedly executes this process for each of the steel plates.

The outputting section 850 outputs the plurality of processing operations arranged in each of the clusters, and the array sequence of the processing operations arranged by the detail-scheduling section 830. This sequence depends on the sequence of the clusters arranged by the rough-scheduling section 810, the sequence of the processing operations arranged by the detail-scheduling section 830, and the sequence modified by the local searching section 840.

Figure 9:
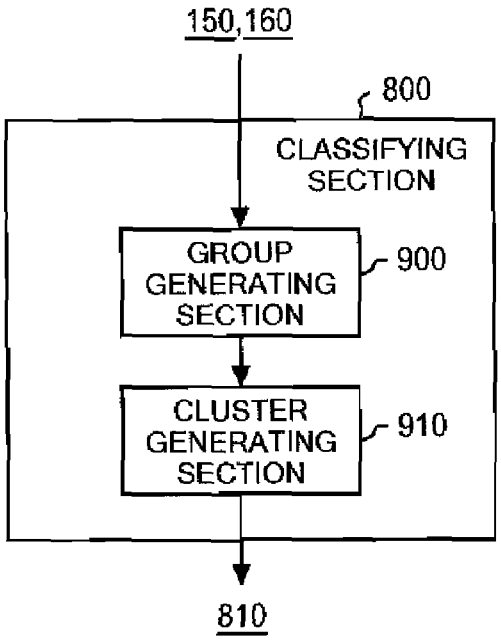
FIG. 9 shows a functional structure of a classifying section 800.

FIG. 9 shows a functional structure of the classifying section 800. The classifying section 800 includes a group generating section 900 and a cluster generating section 910. The group generating section 900 sequentially reads the attribute values of the first attribute from the attribute storage unit 150, and classifies a plurality of processing operations having the same attribute value of the first attribute into a group. In other words, only difficult processing operations are classified into a certain group, and different types of processing operations are not classified into the group. Meanwhile, a plurality of difficult processing operations may be classified into a plurality of groups.

From the attribute storage unit 150, the cluster generating section 910 reads the attribute values of the second and the third attributes of each of a plurality of processing operations classified into a certain group. Then, the cluster generating section 910 rearranges the plurality of processing operations in a sequence satisfying the second sequence constraint and the third sequence constraint. Specifically, the cluster generating section 910 rearranges a plurality of steel plates in descending order of post-rolling width of steel sheets, and judges whether each of the plurality of rearranged processing operations satisfies the third sequence constraint. In a case where the third sequence constraint is not satisfied, for example, in a case where there is a processing operation for a steel plate with a particularly different thickness, this processing operation may be excluded from the rearranged sequence. Then, the cluster generating section 910 selects each part of the plurality of rearranged processing operations as a cluster. The processing operation which is excluded since it does not satisfy the third sequence constraint may form a cluster by itself, or together with another processing operation for a steel sheet with a similar thickness.

Figure 10:
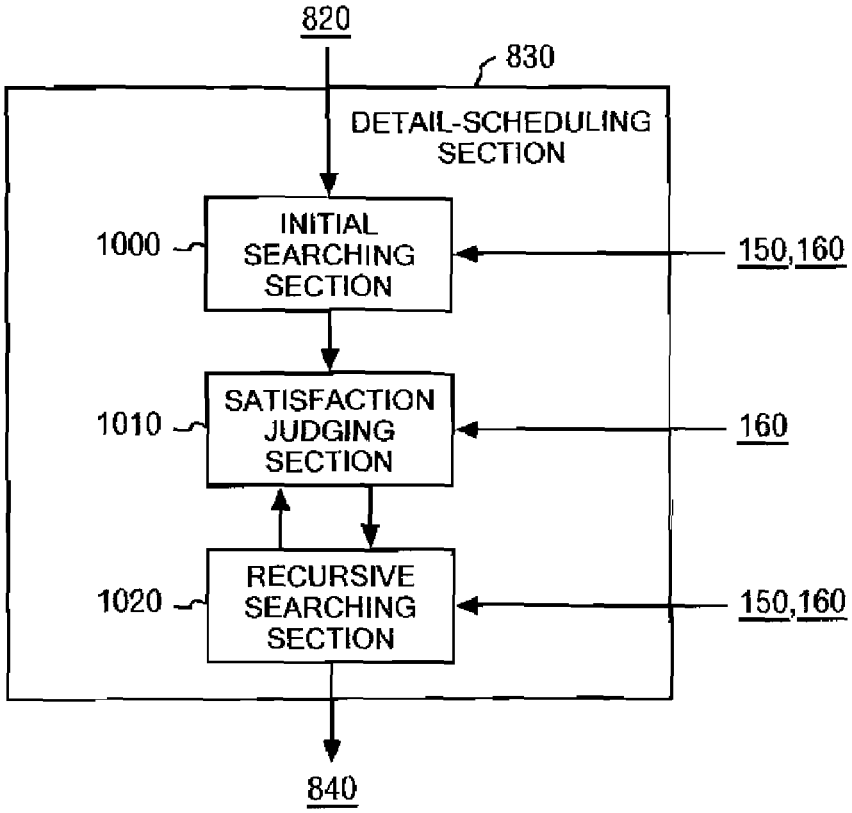
FIG. 10 shows a functional structure of a detail-scheduling section 830.

FIG. 10 shows a functional structure of the detail-scheduling section 830. The detail-scheduling section 830 includes an initial searching section 1000, a satisfaction judging section 1010 and a recursive searching section 1020. The initial searching section 1000 searches for another processing operation (called "a first matching processing operation") satisfying the second sequence constraint with any one of the last processing operations in the first cluster, and the first processing operation in the second cluster arranged next to the first cluster. For example, in order to find such a processing operation, the initial searching section 1000 may search processing operations included in clusters not arranged by the rough-scheduling section 830 among a plurality of processing operations specified by a user for processing a plurality of thick plates 200. In addition, it is desirable that the processing operations to be searched satisfy all the other constraints with the first matching processing operation.

Figure 13:
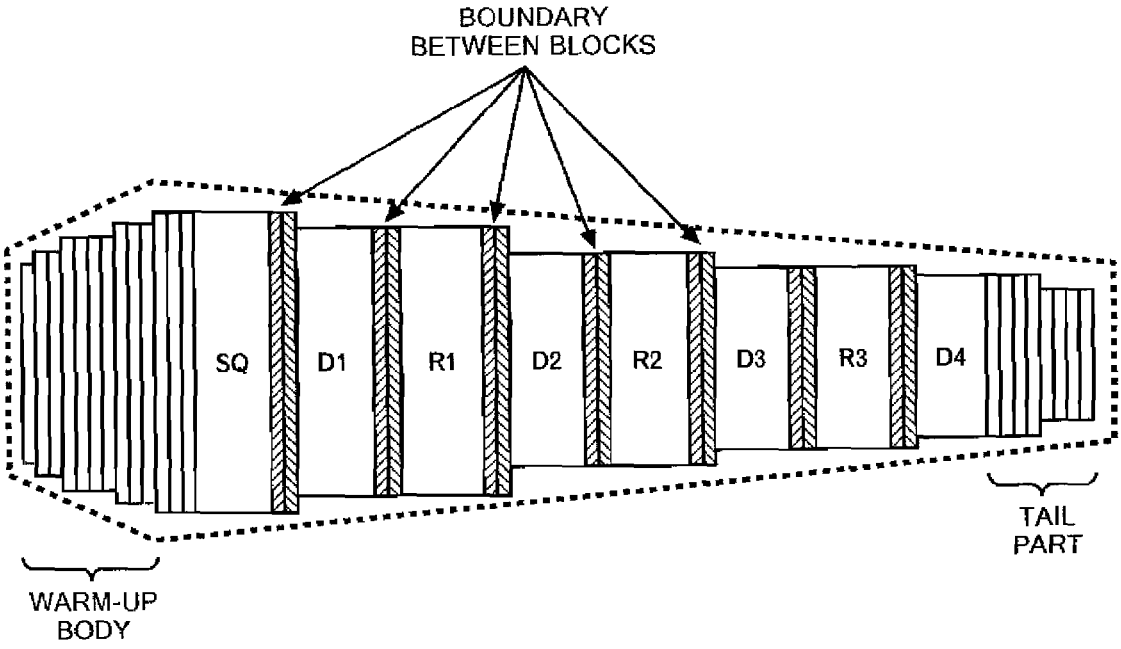
FIG. 13 is a conceptual diagram of a process for generating a detailed schedule satisfying constraints between clusters.

FIG. 13 is a conceptual diagram of a process for generating a detailed schedule satisfying the constraints between the clusters. There is a case where two processing operations arranged at the boundary between two blocks (shaded areas in FIG. 10) do not satisfy the second sequence constraint. In such a case, the initial searching section 1000 scans each of the boundaries between the blocks, and sequentially searches out processing operations to be inserted in the boundaries, as needed, so that the first cluster and the second cluster arranged at each boundary can satisfy the second sequence constraint. For each boundary, the satisfaction judging section 1010 and the recursive searching section 1020 execute the following processes.

The description goes back to FIG. 10. The satisfaction judging section 1010 judges whether the second sequence constraint is satisfied between a first searched-out processing operation and the other one (called "a second matching processing operation") of the last processing operation in the first cluster, and the first processing operation in the second cluster. On condition that the second sequence constraint is not satisfied, the recursive searching section 1020 further searches out another processing operation (called a "second searched-out processing operation") satisfying the second sequence constraint with the first searched-out processing operation, and gives the second searched-out processing operation to the satisfaction judging section 1010. Upon receipt of the second searched-out processing operation, the satisfaction judging section 1010 judges whether the second sequence constraint is satisfied between the second searched-out processing operation and the second matching processing operation. On condition that the second sequence constraint is not satisfied, the recursive searching section 1020 further searches out a processing operation satisfying the second sequence constraint with the second searched-out processing operations.

Once the satisfaction judging section 1010 judges that the second sequence constraint is satisfied, the detail-scheduling section 830 arranges at least one of the processing operations that are sequentially searched out by the initial searching section 1000 and the recursive searching section 1020, next to the first cluster and before the second cluster.

Figure 14:
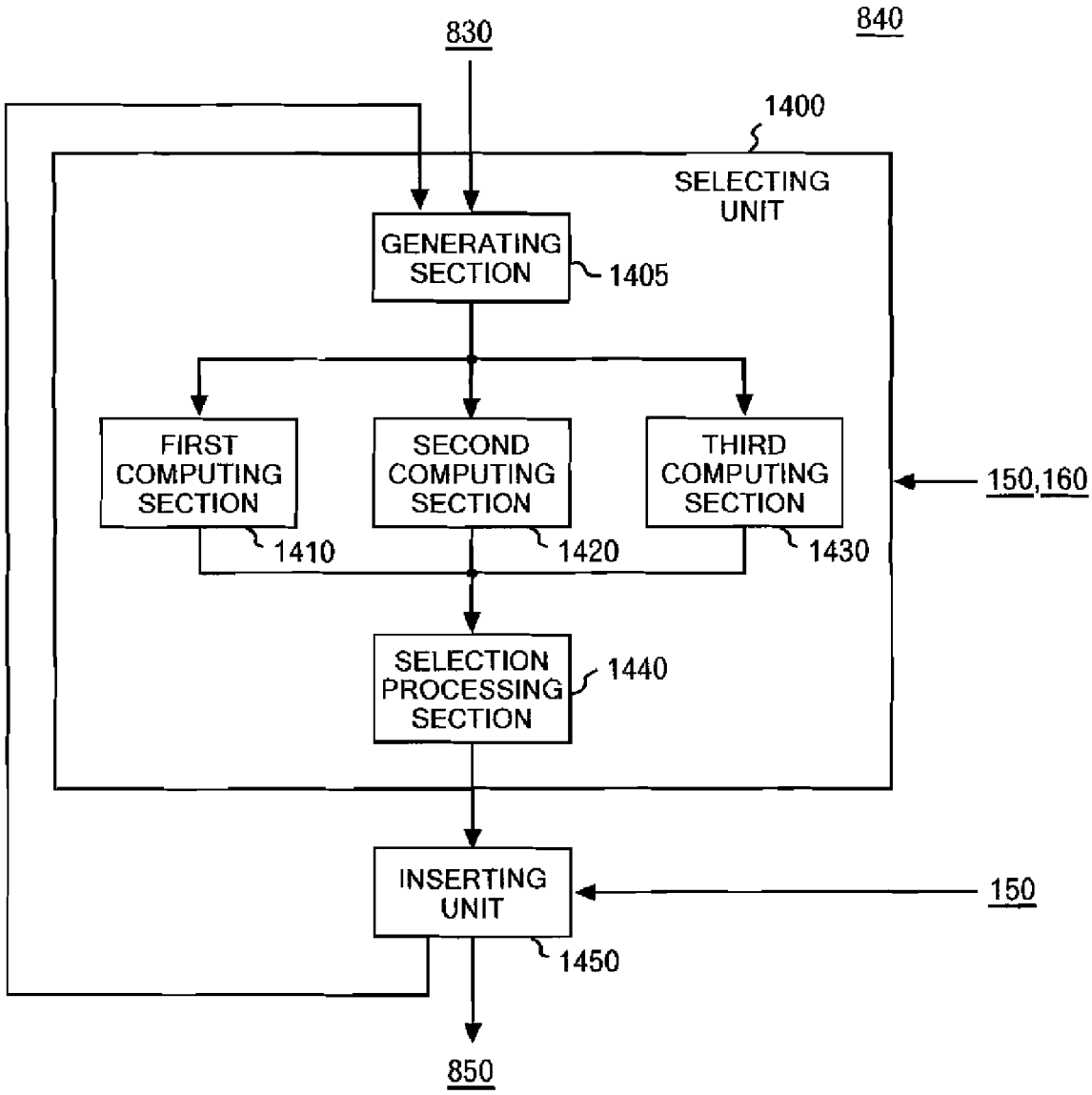
FIG. 14 shows a functional structure of a local searching section 840.

FIG. 14 shows a functional structure of the local searching section 840. The local searching section 840 includes a selecting unit 1400 and an inserting unit 1450. From the detail-scheduling section 830, the selecting unit 1400 receives information on the array of steel plates arranged in the processing sequence of steel plates. The steel plates in this array are arranged in the processing sequence already determined by the rough-scheduling section 810, the judging section 820 and the detail-scheduling section 830. In other words, this array of steel plates satisfies all the sequence constraints and the positional constraint on the upper limit value, but does not always satisfy the constraint on the lower limit value.

As the position into which a new steel plate is to be inserted in this array of steel plates, the selecting unit 1400 preferentially selects a position maximizing the expectation value of the number of steel plates that can be further inserted into the array of steel plates after the new steel plate is inserted therein while satisfying the positional constraints. Then, the inserting unit 1450 inserts the new steel plate into the selected position, and outputs data representing the array of steel plates after the insertion. When the attribute storage unit 150 still stores a steel plate whose position in the processing sequence is not determined, and whose insertion is not yet attempted, the inserting unit 1450 may output, to the selecting unit 1400, data representing the array of steel plates after the insertion, and thereby may cause another new steel plate to be inserted in the array of steel plates. Preferably, for all the steel plates among the steel plates of the base number whose positions in the processing sequence are not yet determined, the selecting unit 1400 repeatedly executes the process of selecting the position for inserting a steel plate not yet having a position in the processing sequence determined.

The selecting unit 1400 includes, as a specific structure, a generating section 1405, a first computing section 1410, a second computing section 1420, a third computing section 1430 and a selection processing section 1440. From the problem storage unit 160, the generating section 1405 reads the constraint on the upper limit value corresponding to the type of the new steel plate to be inserted into the array of steel plates already arranged in the processing sequence. After that, by inserting the new steel plate into each of a plurality of positions before the upper limit value in the array of steel plates, the generating section 1405 generates a plurality of arrays of steel plates representing candidates for the array of steel plates after the insertion. Then, the generating section 1405 outputs data representing these arrays of steel plates to the first computing section 1410.

The first computing section 1410 executes the following process for each of the generated arrays of steel plates. Firstly, the first computing section 1410 selects the steel plate arranged in the last position of each type of steel plates, and reads, from the problem storage unit 160, the constraint on the upper limit value of each selected type of steel plates. Thereafter, the first computing section 1410 computes the expectation value of the number of steel plates insertable into each segment partitioned by selected steel plates. This computation of the expectation value is based on the difference value between the position of each selected steel plate and the upper limit value of the type of the selected steel plate. The difference value is equivalent to the numeric value given as the number of steel plates m in FIG. 4, for example. The greater the numeric value m, the greater the expectation value of the number of steel plates insertable after the insertion.

Next, as the position into which the new steel plate is to be inserted, the selection processing section 1440 selects the position having the new steel plate inserted in order to generate the array of steel plates having a larger sum total of the expectation values each computed for a corresponding segment. Then, the selection processing section 1440 informs the inserting unit 1450 of the selected position. Incidentally, the selection of the insertable position is desired to be based on the constraint on the lower limit value and the processing efficiency after the insertion in addition to the above-described expectation value of the number of insertable steel plates. The second computing section 1420 judges whether the constraint on the lower limit value is satisfied, and the third computing section 1430 estimates how high the processing efficiency is. Hereinafter, the operations of these sections will be described.

The second computing section 1420 executes the following process for each of the arrays of steel plates generated by the generating section 1405. Firstly, the second computing section 1420 selects the first steel plate arranged in the first position of each type of steel plates, and reads the constraint on the lower limit value of the selected steel plate type. After that, the second computing section 1420 computes the difference value between the position of each selected steel plate and the lower limit value of the selected steel plate type. Then, by using the computed difference value, the second computing section 1420 computes an index value indicating how much the array of steel plates violates the positional constraint on the lower limit value. For example, as the computed difference value increases, the array violates the positional constraint on the lower limit value to a larger extent. In contrast, the greater the number of steel plates that do have a determined position in the processing sequence and for which positioning has not yet been attempted, the less the array violates the positional constraint on the lower limit value. This is because as more steel plates can be inserted, it becomes easy to satisfy the positional constraint on the lower limit value.

As the position into which the new steel plate is to be inserted, the selection processing section 1440 preferentially selects the position having the new steel plate inserted in order to generate the array of steel plates having a smaller index value. For the purpose of achieving this selection, it is possible to introduce an evaluation function which takes a smaller value according to the smaller index value and takes a larger value according to the larger expectation value computed by the first computing section 1410. In this case, the selection processing section 1440 only has to select the position maximizing the value of the evaluation function.

The third computing section 1430 computes a first estimated value indicating the efficiency of processing steel plates for each of the arrays of steel plates generated by the generating section 1405. This array of steel plates maximizing the first estimated value is the most desirable array of steel plates from the viewpoint of the processing efficiency at the time of inserting the new steel plate. However, when taken into consideration that the insertion operations are repeatedly carried out, the array of steel plates maximizing the first estimated value is not always the most desirable array of steel plates. For this reason, the selection processing section 1440 selects the position for inserting the steel plate according to a second estimated value obtained by combining the first estimated value with the expectation value computed by the first computing section 1410. For example, the second estimated value is a value of an evaluation function taking a larger value as the first estimated value is larger and taking a larger value as the expectation value computed by the first computing section 1410 is larger.

Note that this first estimated value may be a value computed by using, for example, the objective function of the integer programming problem. In other words, the first estimated value may be determined by evaluating, as higher processing efficiency, a longer total length of steel plates to be rolled by a set of work rolls 110. Alternatively, the first estimated value may be determined by evaluating, as higher processing efficiency, a larger number of difficult processing operations to be performed by a set of work rolls 110. Instead, the first estimated value may be determined by evaluating, as higher processing efficiency, a larger number of difficult processing operations to be performed by a set of work rolls 110. Otherwise, the first estimated value may be determined by evaluating, as higher processing efficiency, a smaller number of recovery processing operations to be performed by a set of work rolls 110. Alternatively, the first estimated value may be determined by evaluating, as higher processing efficiency, less frequency at which the deliveries of steel plates would be actually delayed from delivery deadlines each determined for a corresponding steel plate.

Figure 15:
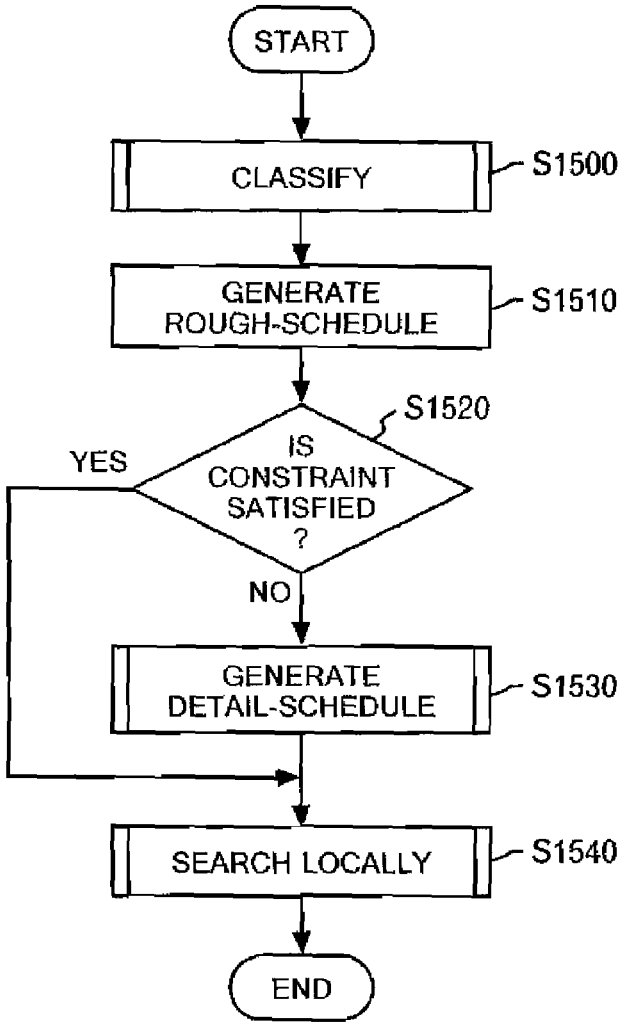
FIG. 15 shows a flowchart of a process for arranging processing operations by classifying them into clusters.

FIG. 15 shows a flowchart of a process for arranging processing operations by classifying them into clusters. The classifying section 800 classifies a plurality of processing operations into a plurality of clusters (S1500). All the plurality of processing operations in a certain cluster have the same attribute value of the first attribute. Here, assume that: C denotes a set of classified clusters; $C^D$ denotes a set of clusters including difficult processing operations; $C^R$ denotes a set of clusters including recovery processing operations; $C^{SQ}$ denotes a set of clusters including superior quality processing operations; and $C^O$ denotes a set of clusters other than the three sets $C^D$, $C^R$ and $C^{SQ}$ among the set C.

The rough-scheduling section 810 regards the first sequence constraint and the third sequence constraint as constraints between a plurality of clusters, and arranges the plurality of processing operations in a sequence maximizing the efficiency of steel plate processing by solving an integer programming problem (S1510). This integer programming problem is a problem for finding to which block in which round each of the plurality of clusters is to be assigned. Here, assume that R denotes a set of rounds to which the clusters are to be assigned, and that S denotes a set of blocks.

A variable of this integer programming problem holds, for each block and for each cluster, a state value indicating whether or not processing operations included in the cluster are performed in the block. Here, $x_{i,j,k}$ denotes this variable. In a case where a cluster $k \in C$ is assigned to a block $j \in S$ in a round $i \in R$, this variable takes 1, and otherwise, this variable takes zero.

This integer programming problem includes the first sequence constraint regarded as the constraint between clusters. For example, the first sequence constraint is expressed as linear inequalities for each of the first attributes. These linear inequalities employ, as a variable, the range of numbers of clusters which include the processing operations having the same first attribute value, and which are assigned to each block. Formula 1 shows the constraint between difficult manufacture slabs, which is one of the first sequence constraints. This constraint indicates whether a cluster consisting of difficult processing operations is assigned to each of the difficult manufacturing blocks (D1 to D3), or a cluster other than that is assigned thereto.

[Formula 1]

$$\begin{aligned}\sum_{k\in C^D\cup C^O} x_{i,D1,k} &= \sum_{k\in C^D\cup C^O} x_{i,D2,k}\\ &= \sum_{k\in C^D\cup C^O} x_{i,D3,k}\\ &= \sum_{k\in C^D\cup C^O} x_{i,D4,k}\\ &= 1 \text{ for each } i\in R\end{aligned} \qquad \text{Formula 1}$$

$$\begin{aligned}\sum_{k\in C/(C^D\cup C^O)} x_{i,D1,k} &= \sum_{k\in C/(C^D\cup C^O)} x_{i,D2,k}\\ &= \sum_{k\in C/(C^D\cup C^O)} x_{i,D3,k}\\ &= \sum_{k\in C/(C^D\cup C^O)} x_{i,D4,k}\\ &= 0 \text{ for each } i\in R\end{aligned}$$

Additionally, the constraint between difficult manufacture slabs may also be expressed as inequalities shown in Formula 2. This constraint prohibits assigning a cluster consisting of difficult processing operations of a first group (Gx) to a block before a block to which a cluster consisting of difficult processing operations of a second group (Gy) is assigned. Certain characteristics of processing operations allow the addition of such a constraint.

[Formula 2]

$$\begin{aligned}&\sum_{k\in G_x} x_{i,D1,k} + \sum_{k\in G_y} x_{i,D2,k} \le 1 \text{ for each } i\in R\\ &\sum_{k\in G_x} x_{i,D2,k} + \sum_{k\in G_y} x_{i,D3,k} \le 1 \text{ for each } i\in R\\ &\sum_{k\in G_x} x_{i,D3,k} + \sum_{k\in G_y} x_{i,D4,k} \le 1 \text{ for each } i\in R\end{aligned} \qquad \text{Formula 2}$$

Moreover, the constraint between difficult manufacture slabs may be expressed as inequalities shown in Formula 3. This constraint prohibits assigning a cluster consisting of difficult processing operations of a first group (Gx) to the same round of a cluster consisting of difficult processing operations of a second group (Gy). Certain characteristics of processing operations also allow the addition of such a constraint.

[Formula 3]

$$\begin{aligned}&\sum_{j\in S,k\in G_x} x_{i,j,k} \le L\cdot z_1\\ &\sum_{j\in S,k\in G_y} x_{i,j,k} \le L\cdot z_2\\ &z_1 + z_2 \le 1 \text{ for each } i\in R\end{aligned} \qquad \text{Formula 3}$$

Note that, in Formula 3, L is a sufficiently large positive constant, and that each of $z_1$ and $z_2$ is a two-valued variable taking a value of 1 or 0.

Furthermore, Formula 4 shows the constraint on a superior quality slab, which is one of the first sequence constraints. This constraint indicates that the superior quality processing operation requiring a steel sheet with superior quality to a predetermined standard quality should be performed in a block SQ.

[Formula 4]

$$\begin{aligned}&\sum_{k\in C^{SQ}\cup C^O} x_{i,SQ,k} = 1 \text{ for each } i\in R\\ &\sum_{k\in C/(C^{SQ}\cup C^O)} x_{i,SQ,k} = 0 \text{ for each } i\in R\end{aligned} \qquad \text{Formula 4}$$

Moreover, Formulas 5 and 6 show the constraint on a recovery slab, which is one of the first sequence constraints. This constraint indicates that a recovery processing operation must be performed between two clusters each consisting of difficult processing operations.

[Formula 5]

$$\begin{aligned}\sum_{k\in C^R\cup C^O} x_{i,R1,k} &= \sum_{k\in C^R\cup C^O} x_{i,R2,k}\\ &= \sum_{k\in C^R\cup C^O} x_{i,R3,k}\\ &= 1 \text{ for each } i\in R\end{aligned} \qquad \text{Formula 5}$$

$$\begin{aligned}\sum_{k\in C/(C^R\cup C^O)} x_{i,R1,k} &= \sum_{k\in C/(C^R\cup C^O)} x_{i,R2,k}\\ &= \sum_{k\in C/(C^R\cup C^O)} x_{i,R3,k}\\ &= 0 \text{ for each } i\in R\end{aligned}$$

[Formula 6]

$$\begin{aligned}&\sum_{k\in G_X} x_{i,D1,k} + \sum_{k\in G_y} x_{i,D2,k} \le \sum_{k\in C^R} x_{i,R1,k} + 1 \text{ for each } i\in R\\ &\sum_{k\in G_X} x_{i,D2,k} + \sum_{k\in G_y} x_{i,D3,k} \le \sum_{k\in C^R} x_{i,R2,k} + 1 \text{ for each } i\in R\end{aligned} \qquad \text{Formula 6}$$

-continued $$\sum_{k \in G_X} x_{i,D3,k} + \sum_{k \in G_y} x_{i,D4,k} \leq \sum_{k \in C^R} x_{i,R3,k} + 1 \text{ for each } i \in R$$

In addition, this integer programming problem has a constraint indicating that no more than one cluster is assigned to each block. This constraint is expressed, for example, as Formula 7.

[Formula 7]

$$\sum_{i \in R_j, i \in S} x_{i,j,k} \leq 1 \text{ for each } k \in C \qquad \text{Formula 7}$$

This integer programming problem also includes the third sequence constraint regarded as a constraint between clusters. For example, the rough-scheduling section 810 regards the third sequence constraint as a constraint indicating that a post-rolling steel sheet from the last processing operation in a cluster arranged earlier is wider than a post-rolling steel sheet from the first processing operation in a cluster arranged later. Following this constraint, the rough-scheduling section 810 arranges a plurality of clusters. The third sequence constraint regarded as the constraint between clusters is expressed as Formula 8 shown below.

[Formula 8]

$$\sum_{k \in C} \text{Width}L(k) \cdot x_{i,D1,k} - \sum_{k \in C} \text{Width}F(k) \cdot x_{i,R1,k} \geq 0 \text{ for each } i \in R \qquad \text{Formula 8}$$

Note that WidthF(k) denotes the width of a post-rolling steel sheet that is rolled in a first processing operation arranged in a cluster k, and that WidthL(k) denotes the width of a post-rolling steel sheet that is rolled in the last processing operation in the cluster k.

The plurality of clusters are arranged by solving the above-described integer programming problem. Thereafter, the judging section 820 judges whether or not the second sequence constraint is satisfied between the last processing operation in the first cluster, and the first processing operation in the second cluster arranged next to the first cluster. (S1520). On condition that the second sequence constraint is not satisfied (S1020: NO), the detail-scheduling section 830 searches out at least one of the other processing operations each satisfying the second sequence constraint with each of the last processing operation in the first cluster, and the first processing operation in the second cluster (S1530). Then, the detail-scheduling section 830 arranges the searched-out processing operation next to the first cluster and before the second cluster. The detail-scheduling section 830, furthermore, may search the clusters not arranged by the rough-scheduling section 810 in order to find processing operations to be arranged in the warm-up body and a tail part shown in FIG. 13.

On condition that the second sequence constraint is satisfied by the rough-scheduling section 810 and/or the detail-scheduling section 830, the local searching section 840 attempts to modify the sequence of the processing operations in order to further improve the processing efficiency (S1540). For example, with respect to each of the steel plates having the attributes stored in the attribute storage unit 150 and not having a determined position in the processing sequence, the local searching section 840 judges the change of the value of the objective function by inserting the steel plate into the array of the steel plates arranged by the rough-scheduling section 810 and the detail-scheduling section 830. For instance, the local searching section 840 judges whether or not the insertion of the steel plate allows the sequence constraints to be satisfied, and the value of the objective function to increase. In a case where the sequence constraints are satisfied and where the value of the objective function increases, the local searching section 840 inserts the steel plate.

Figure 16:
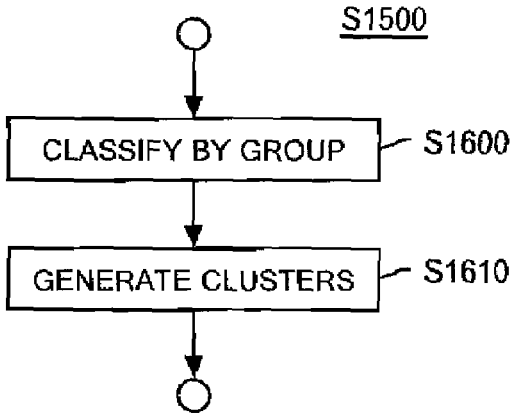
FIG. 16 shows a detail of the process in step S1500.

FIG. 16 shows a detail of the process in step S1500. The group generating section 900 sequentially reads the attribute values of the first attribute from the attribute storage unit 150, and classifies a plurality of processing operations having the same attribute value of the first attribute into a group (S1600). In other words, only difficult processing operations, for example, are classified into a certain group, and the other types of processing operations are not classified into the group. Meanwhile, a plurality of difficult processing operations may be classified into a plurality of groups.

Subsequently, the cluster generating section 910 classifies the processing operations included in each group into a plurality of clusters (S1610). In each of the clusters, the processing sequence satisfies the second sequence constraint and the third sequence constraint. To be more precise, from the attribute storage unit 150, the cluster generating section 910, firstly, reads the attribute values of the respective second and third attributes of each of a plurality of processing operations classified into a certain group. Then, the cluster generating section 910 rearranges the plurality of processing operations in a sequence satisfying the second sequence constraint and the third sequence constraint. In other words, for example, the cluster generating section 910 rearranges a plurality of steel plates in descending order of width of post-rolling steel sheets, and judges whether each of the plurality of processing operations thus rearranged satisfies the third sequence constraint. In a case where the third sequence constraint is not satisfied, for example, in a case where there is a processing operation for a steel plate with a particularly different thickness, this processing operation may be excluded from the rearranged sequence. Then, the cluster generating section 910 selects each part of the plurality of thus rearranged processing operations as a cluster. The processing operation that does not satisfy the third sequence constraint and thereby is excluded may form another cluster, by itself or together with another processing operation to produce a steel sheet with a similar thickness.

Figure 17:
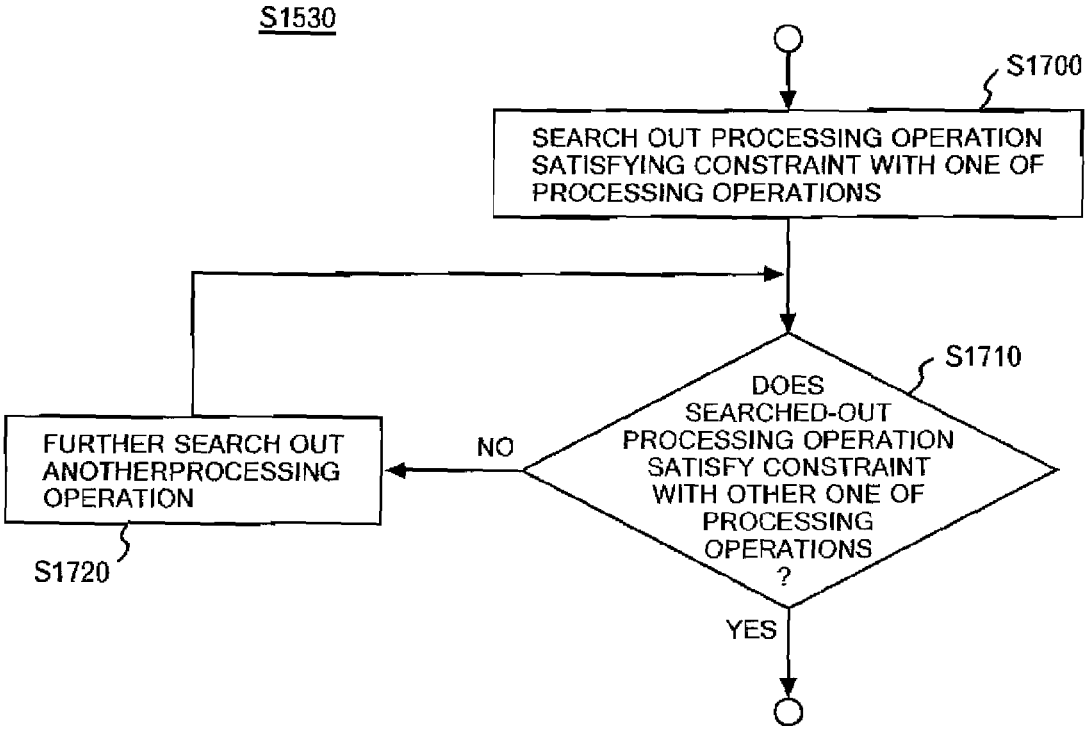
FIG. 17 shows a detail of the process in step S1530.

FIG. 17 shows a detail of the process in step S1530. The initial searching section 1000 searches out another processing operation satisfying the second sequence constraint with any one (first matching processing operation) of the last processing operation in the first cluster, and the first processing operation in the second cluster arranged next to the first cluster (S1700). In order to find such a processing operation, for example, the initial searching section 1000 may search the processing operations included in clusters not arranged by the rough-scheduling section 830 among a plurality of processing operations specified by a user for processing a plurality of thick plates 200.

The satisfaction judging section 1010 judges whether the thus searched-out processing operation satisfies the second sequence constraint with the other one (second matching processing operation) of the last processing operation in the first cluster, and the first processing operation in the second cluster (S1710). On condition that the second sequence constraint is not satisfied (S1710: NO), the recursive searching section 1020 further searches out another processing operation satisfying the second sequence constraint with this searched-out processing operation (S1720), and causes the process to go back to step S1710.

Once the satisfaction judging section 1010 judges that the second sequence constraint is satisfied, the detail-scheduling section 830 terminates the process shown in FIG. 17. Then, the detail-scheduling section 830 arranges, next to the first cluster and before the second cluster, at least one of the processing operations that are sequentially searched out by the initial searching section 1000 and the recursive searching section 1020.

Figure 18:
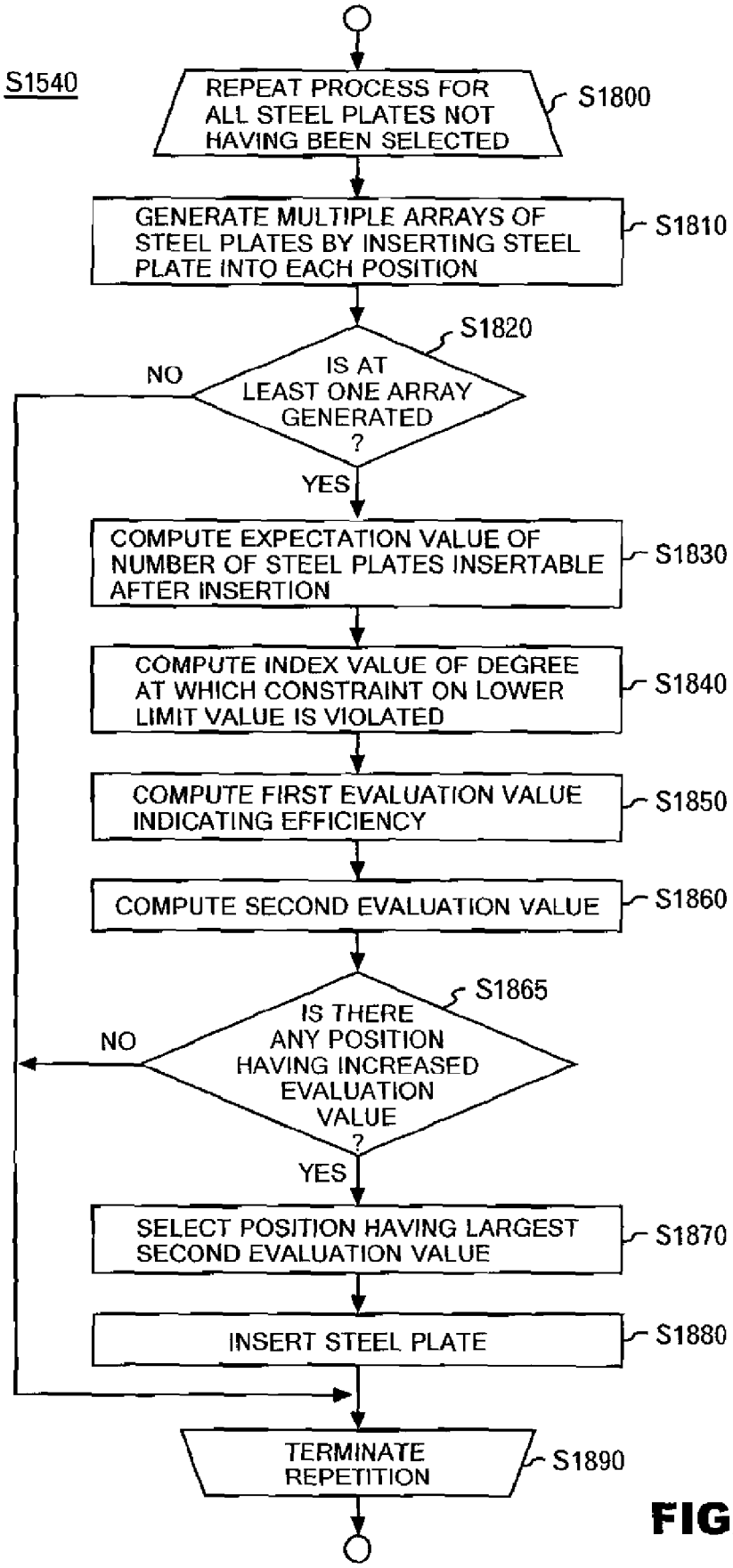
FIG. 18 shows a detail of the process in step S1540.

FIG. 18 shows a detail of the process in step S1540. The local searching section 840 repeatedly executes the following process for each of remaining steel plates whose attributes are stored in the attribute storage unit 150 except the ones selected as having the determined positions in the processing sequence (S1800). Firstly, the generating section 1405 generates a plurality of arrays of steel plates by inserting each of the remaining steel plates into each insertable position, before the upper limit value of the type of the remaining steel plate, in each of the arrays of steel plates already determined as the processing sequence (S1810). However, the arrays are generated on condition that the arrays satisfy the other sequence constraints even when the remaining steel plates are inserted thereinto.

The generating section 1405 judges whether or not at least one array of steel plates is generated by inserting at least one of the remaining steel plates (S1820). In other words, the generating section 1405 judges whether or not there is at least one position into which one of the remaining steel plates can be inserted while satisfying the sequence constraints. When the array generation fails (S1820: NO), the local searching section 840 moves the process to step S1890, and repeats the process for the next one of the remaining steel plates. On the other hand, when the array generation succeeds (S1820: YES), the first computing section 1410 computes the expectation value for each of the generated arrays of steel plates, and the expectation value is for the number of steel plates that can be further inserted thereinto while satisfying the positional constraint on the upper limit value (S1830). Hereinafter, the computation process will be described in detail by referring to FIGS. 19 and 20.

Figure 19:
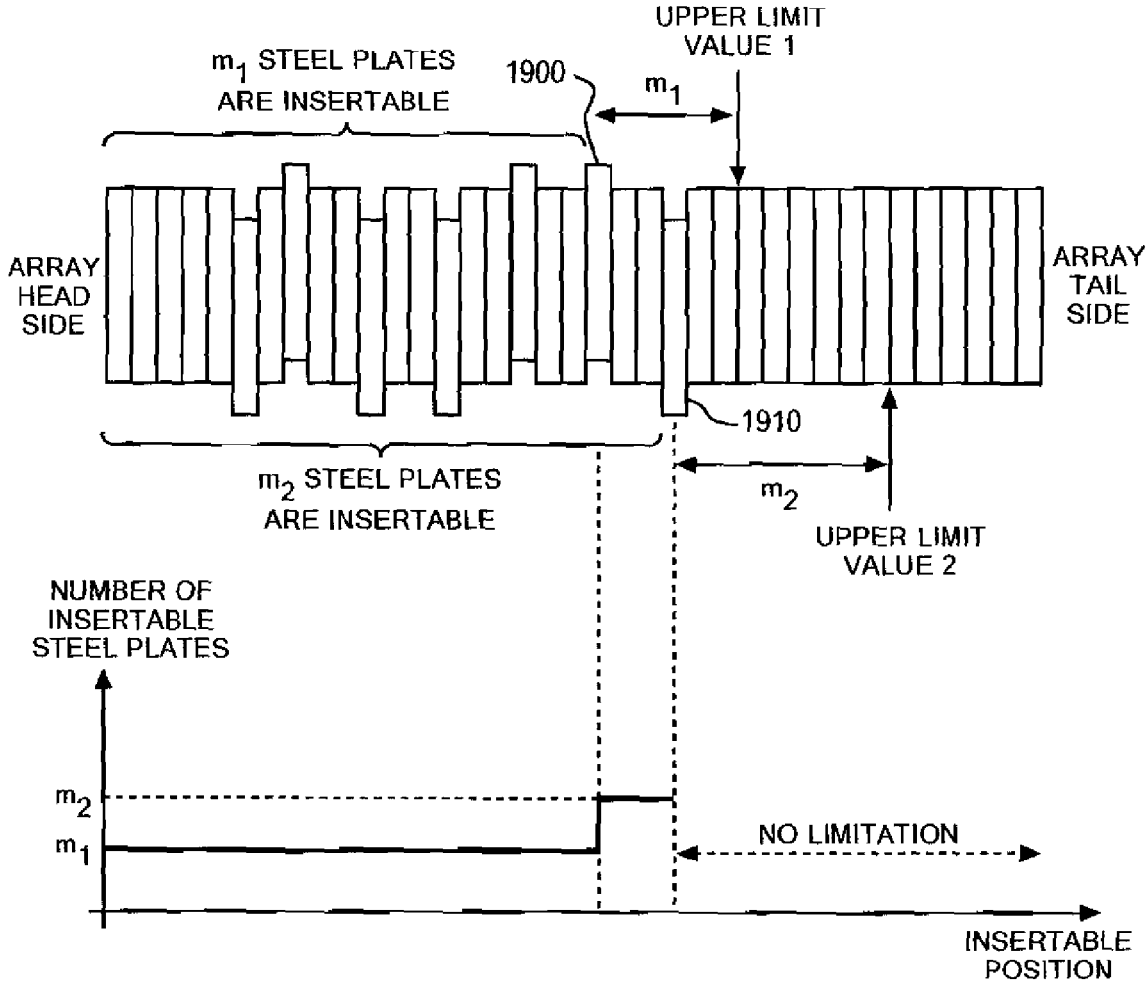
FIG. 19 shows the number of insertable steel plates determined on the basis of a plurality of constraints.

FIG. 19 shows the numbers of insertable steel plates determined on the basis of the plurality of constraints. Various types of steel plates mixedly exist in an array of steel plates arranged in an already-determined processing sequence. For example, assume that steel plates of a first type and a second type mixedly exist, and that the steel plates arranged in the last positions of the first type and the second type of steel plates are called a steel plate 1900 and a steel plate 1910, respectively. In addition, these types of steel plates are restricted in the position by the different positional constraints. For instance, the number of steel plates insertable before the steel plate 1900 is the difference value $m_1$ between the position of the steel plate 1900 and the upper limit value 1 of a positional constraint 1. On the other hand, the number of steel plates insertable before the steel plate 1910 is the difference value $m_2$ between the position of the steel plate 1910 and the upper limit value 2 of a positional constraint 2.

Figure 20:
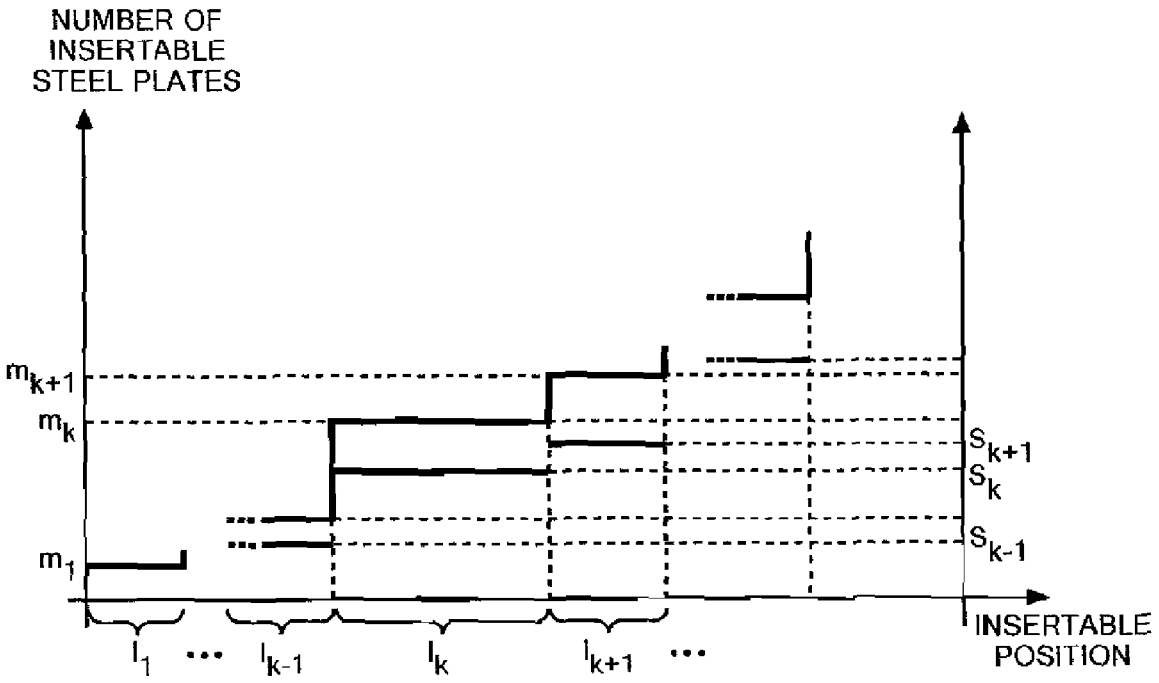
FIG. 20 shows the relationship between an insertable position and the number of insertable steel plates.

The two types of steel plates are restricted by the two constraints in a segment before both the steel plate 1900 and the steel plate 1910. In other words, in this segment, due to the restriction by the two constraints, only a smaller number of steel plates of $m_1$ and $m_2$ can be newly inserted into the array. In this way, the number of insertable steel plates is determined in each segment, and this relationship between the number of insertable steel plates and segments can be expressed as a graph with the insertable position on the horizontal axis and the number of insertable steel plates on the vertical axis. Here, since the steel plate 1900 is arranged before the steel plate 1910, the segment before the steel plate 1900 is restricted by the two constraints, and thus the number of insertable steel plates is $m_1$. In contrast, since the segment between the steel plates 1900 and 1910 is restricted only by the constraint 2 on the upper limit value 2, the number of insertable steel plates is $m_2$. FIG. 20 shows a graph indicating the number of insertable steel plates in a case where the number of constraints is increased to 3 or more.

FIG. 20 shows a relationship between the insertable position and the number of insertable steel plates. Here, firstly select the last steel plate of each of the types from the array of steel plates already arranged in the processing sequence, and assume the segments partitioned by the selected steel plates to be 1 to n from the forefront side. Moreover, assume that $l_1$ to $l_n$ denote the numbers of steel plates included in the segments 1 to n, respectively, and that $m_1$ to $m_n$ denote the numbers of steel plates insertable into the segments 1 to n, respectively. When a graph is created with the insertable position on the horizontal axis and the number of insertable steel plates on the vertical axis on these assumptions, obtained is a stepped graph increasing toward the right with the number of insertable steel plates gradually increasing. This is because the types of influential positional constraints become less as the insertable position becomes nearer to the end-tail of the array.

With reference to this graph, the descriptions will be provided in detail for a method with which first computing section 1410 computes the expectation values of the numbers of insertable steel plates. Firstly, the first computing section 1410 computes various types of information indicated in the graph in order to compute the expectation value. More specifically, the first computing section 1410 computes, as $m_1$ to $m_n$, each of the difference values between the position of the last steel plate serving as the boundary on the end-tail side in each segment and the upper limit value of the type of the last steel plate. In addition, the first computing section 1410 computes the numbers $l_1$ to $l_n$ of steel plates already arranged in the respective segments. Then, the first computing section 1410 computes the expectation values by using these types of information.

Here, the computing of a relaxed expectation value that is the expectation value under relaxed constraints is explained. The left side of the following Formula 9 shows the probability that a randomly selected steel plate does not violate the sequence constraints when being inserted into a randomly selected position in a certain segment k.

[Formula 9]

$$(1-(1-p)^l)\frac{l_k}{l} \approx pl_k. \qquad \text{Formula 9}$$

Here, l denotes the number of steel plates included in the array of steel plates arranged in the already-determined processing sequence. Since p is the probability that a randomly selected steel plate can be inserted into a randomly selected position without violating the sequence constraints, the probability that a steel plate can be inserted into at least one position without violating the sequence constraints is $(1-(1-p)^l)$. Then, the probability that the segment k includes a position insertable without violation is obtained by multiplying the probability by $l_k/l$.

In addition, when the probability p is sufficiently smaller than 1, $(1-p)^l$ can be approximated as 1-pl. As a result, the left side of Formula 9 is transformed into the right side thereof.

Here, assume that the positional constraints of the upper limit values is relaxed for steel plates to be inserted thereafter, and that $l_k^n$ denotes the length of the segment k into which the n-th steel plate is to be inserted. Then, the following recurrence formula 10 is established.

[Formula 10]

$$l_k^{n+1}=l_k^n+pl_k^n=(1+p)l_k^n \quad \text{Formula 10}$$

From this Formula 10, the general term of $l_k^n$ is determined as Formula 11.

[Formula 11]

$$l_k^n=l_k(1+p)^n \quad \text{Formula 11}$$

When N denotes a value obtained in a way that the number of steel plates neither having a determined position in the processing sequence nor being attempted to be inserted is subtracted from the base number of steel plates having the attributes stored in the attribute storage unit 150, the relaxed expectation value of the number of steel plates insertable into the segment k is expressed as a product of the number N, the probability p and the number $l_k$ in the segment k (Formula 12).

[Formula 12]

$$l_k^N-l_k=l_k(1+p)^N-l_k\approx Npl_k \quad \text{Formula 12}$$

The first computing section 1410 computes the relaxed expectation value by calculating Formula 12. However, this expectation value is a relaxed one under the relaxed constraint on the upper limit value. For this reason, in consideration of the positional constraint on the upper limit value, the number of steel plates insertable into the segment k should be limited to $m_k$ or less. Moreover, the number $m_k$ merely indicates the number of insertable steel plates in a case where a steel plate is inserted only into the segment k. For this reason, if one or more steel plates are inserted into the segment before the segment k, the number of steel plates insertable into the segment k further decreases. Specifically, the number of insertable steel plates decreases by the number of steel plates inserted into the segment before the segment k. When $s_k$ denotes the expectation value of the number of steel plates inserted into the segment k, the expectation value is expressed as the following Formula 13.

[Formula 13]

$$s_k=\min\left(m_k-\sum_{l=1}^{k-1}s_l,\ Npl_k\right) \quad \text{Formula 13}$$

$s_k$ for each of the segments k is computed by calculating Formula 13 with k increased from 1 one by one.

[Formula 14]

$$s=\sum_k s_k \quad \text{Formula 14}$$

As shown in Formulas 13 and 14, for each of the segments k from the forefront, the first computing section 1410 selects, as the expectation value of the number of insertable steel plates, a smaller one of: a value obtained by subtracting the sum total of the expectation values corresponding to the segments before the segment k, from the number $m_k$ of steel plates insertable into the segment k; and the relaxed expectation value $Npl_k$ computed for the segment k. In this way, the first computing section 1410 can compute the expectation values of the numbers of insertable steel plates for all the segments.

Here, the description goes back to FIG. 18. Subsequently, the second computing section 1420 computes the index value for each of the generated arrays of steel plates, the index value indicating the degree at which the array of steel plates violates the constraint on the lower limit value (S1840). This computation is carried out in the following procedure, for example. The second computing section 1420 selects the first steel plate of each type of steel plates and computes, for each of the selected first steel plates, the expectation value of the number of steel plates to be inserted into the segment before the first steel plate. Since the segment before the first steel plate should indeed satisfy the constraint on the upper limit value, the number of steel plates to be inserted into the segment before the front steel plate is equal to the relaxed expectation values. In other words, the second computing section 1420 computes the expectation value by multiplying: the number N obtained by subtracting the number of steel plates in the array from the base number; the satisfaction probability p; and the number $l_k$ of steel plates included in the segment before the front steel plate.

Then, with respect to each of types of steel plates having the first steel plate whose position does not reach the lower limit value even when the expectation value is added to the position, the second computing section 1420 first computes the difference value between the lower limit value and the value obtained by adding the expectation value to the position of the first steel plate, and then computes the index value by summing up the difference values. This index value indicates the possibility that, even when the inserting operation is repeatedly executed for all of the base number of steel plates, the constraint on the lower limit value would not be satisfied at the time of completion of the repeated inserting operations.

Next, the third computing section 1430 computes the first estimated value indicating the efficiency of steel plate processing for each of the arrays of steel plates generated by the generating section 1405 (S1850). After that, the selection processing section 1440 selects the position into which a steel plate is to be inserted, according to a second estimated value obtained by combining the first estimated value, the expectation value computed by the first computing section 1410 and the index value computed by the second computing section 1420 (S1860). For example, this second estimated value is a value of an evaluation function which takes a larger value when the first estimated value is larger, which takes a larger value when the expectation value computed by the first computing section 1410 is larger, and which takes a larger value when the index value computed by the second computing section 1420 is smaller.

The selection processing section 1440 judges whether or not the second estimated value increases in any one of the arrays of steel plates generated by the generating section 1405 (S1865). If the second estimated value does not increase (S1865: NO), the local searching section 840 moves the process to S1890, and repeats the process for the next steel plate. If the second estimated value increases (S1865: YES), the selection processing section 1440 selects the position having a steel plate inserted therein in order to generate the array of steel plates having the largest second estimated value (S1870). Thereafter, the inserting unit 1450 inserts the steel plate into the selected position (S1890). The local searching section 840 repeatedly executes the foregoing process for all the steel plates whose attributes are stored in the attribute storage unit 150 (S1890).

In order to increase the processing efficiency by sequentially inserting steel plates into a processing sequence, the local searching section 840, described hereinabove by referring to FIGS. 18 to 20, determines a position into which each of the steel plates is to be inserted, according to the expectation value of the number of steel plates further insertable at later stages. This makes it possible to increase the number of inserted steel plates, and thereby to allow the resultant array of steel plates thus generated to produce even higher processing efficiency. According to an experiment made by the present inventors, the result of comparing the processing efficiencies of the arrays of steel plates before and after the process by the local searching section 840 with each other shows that the processing efficiency after the process was equivalent to or was improved more than before the process with a high probability of 90% or more.

Figure 21:
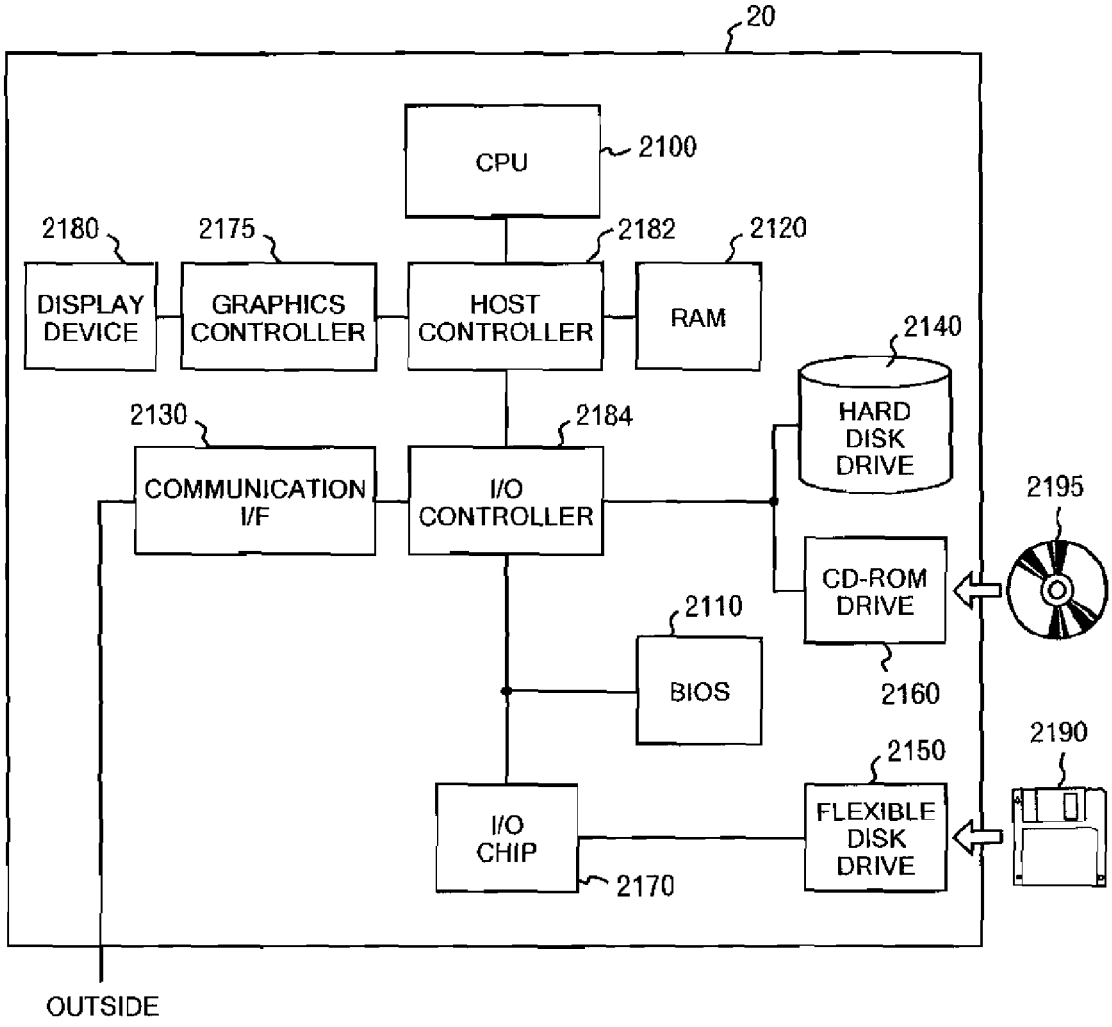
FIG. 21 shows an example of a hardware configuration of an information processing apparatus 20 functioning as the sequence determination system 140.

FIG. 21 shows an example of a hardware configuration of an information processing apparatus 20 functioning as the sequence determination system 140. The information processing apparatus 20 includes a CPU peripheral unit, an input/output unit and a legacy input/output unit. The CPU peripheral unit includes a CPU 2100, a RAM 2120 and a graphics controller 2175, all of which are connected to one another via a host controller 2182. The input/output unit includes a communication interface 2130, a hard disk drive 2140 and a CD-ROM drive 2160, all of which are connected to the host controller 2182 via an input/output controller 2184. The legacy input/output unit includes a ROM 2110, a flexible disk drive 2150 and an input/output chip 2170, all of which are connected to the input/output controller 2184.

The host controller 2182 connects the RAM 2120 to the CPU 2100 and the graphics controller 2175, both of which access the RAM 2120 at a high transfer rate. The CPU 2100 is operated according to programs stored in the ROM 2110 and the RAM 2120, and controls each of the components. The graphics controller 2175 obtains image data generated by the CPU 2100 or the like in a frame buffer provided in the RAM 2120, and causes the obtained image data to be displayed on a display device 2180. Instead, the graphics controller 2175 may internally include a frame buffer that stores the image data generated by the CPU 2100 or the like.

The input/output controller 2184 connects the host controller 2182 to the communication interface 2130, the hard disk drive 2140 and the CD-ROM drive 2160, all of which are higher-speed input/output devices. The communication interface 2130 communicates with an external device via a network. The hard disk drive 2140 stores programs and data to be used by the information processing apparatus 20. The CD-ROM drive 2160 reads a program or data from a CD-ROM 2195, and provides the read-out program or data to the RAM 2120 or the hard disk 2140.

Moreover, the input/output controller 2184 is connected to the ROM 2110 and lower-speed input/output devices such as the flexible disk drive 2150 and the input/output chip 2170. The ROM 2110 stores programs, such as a boot program executed by the CPU 2100 at a start-up time of the information processing apparatus 20, and a program that is dependent on hardware of the information processing apparatus 20. The flexible disk drive 2150 reads a program or data from a flexible disk 2190, and provides the read-out program or data to the RAM 2120 or hard disk drive 2140 via the input/output chip 2170. The input/output chip 2170 is connected to the flexible disk 2190 and various kinds of input/output devices with, for example, a parallel port, a serial port, a keyboard port, a mouse port and the like.

A program to be provided to the information processing apparatus 20 is provided by a user with the program stored in a recording medium such as the flexible disk 2190, the CD-ROM 2195 and an IC card. The program is read from the recording medium via the input/output chip 2170 and/or the input/output controller 2184, and is installed on the information processing apparatus 20. Then, the program is executed. Since an operation that the program causes the information processing apparatus 20 to execute is identical to the operation of the sequence determination system 140 described by referring to FIGS. 1 to 20, the description thereof is omitted here.

The program described above may be stored in an external storage medium. In addition to the flexible disk 2190 and the CD-ROM 2195, examples of the storage medium to be used are an optical recording medium such as a DVD or a PD, a magneto-optic recording medium such as MD, a tape medium, and a semiconductor memory such as an IC card. Alternatively, the program may be provided to the information processing apparatus 20 via a network, by using, as a recording medium, a storage device such as a hard disk and a RAM, provided in a server system connected to a private communication network or the Internet.

Figure 22:
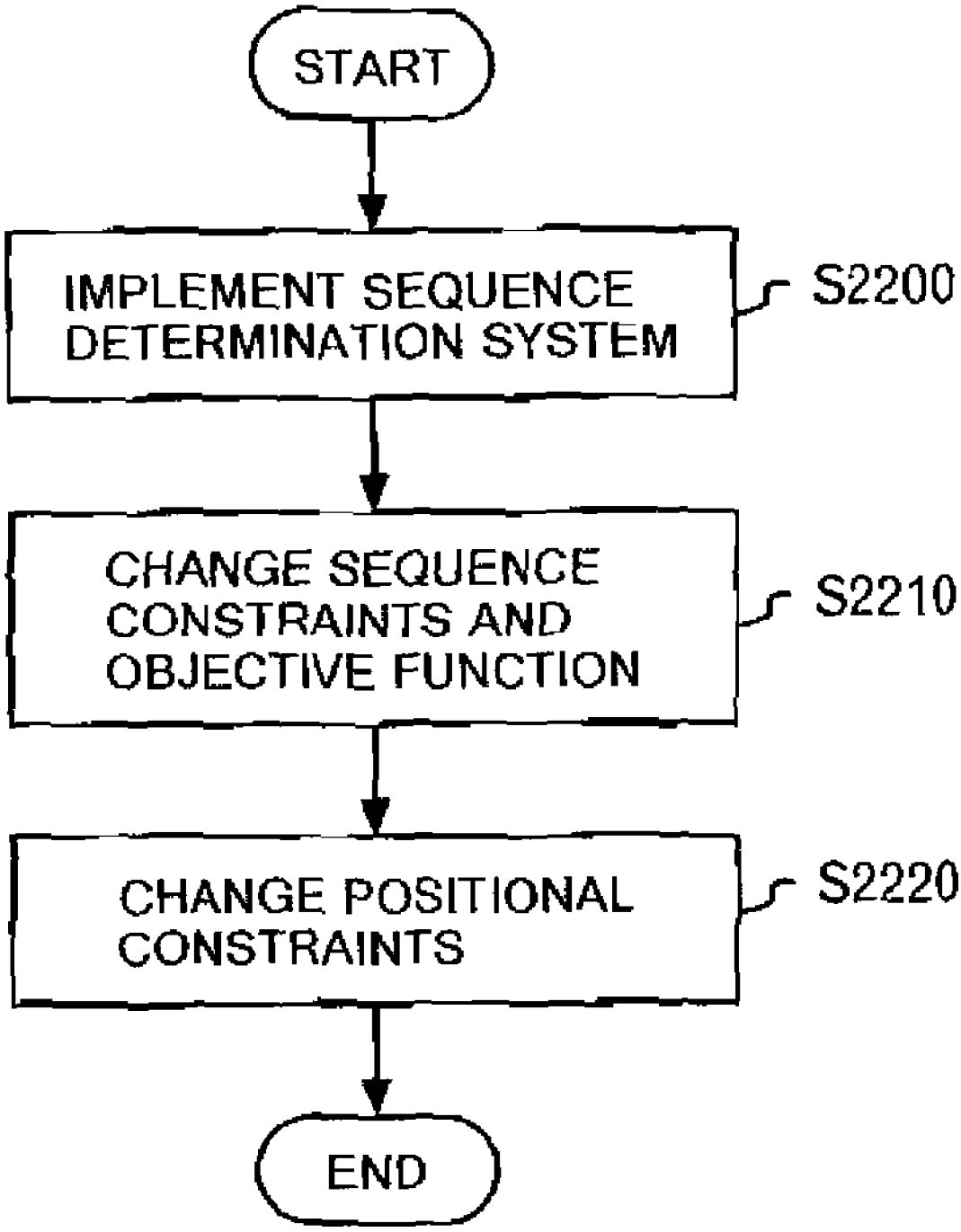
FIG. 22 shows an example of a providing method for providing a service that uses the sequence determination system 140.

FIG. 22 shows an example of a method for providing a service employing the sequence determination system 140. The sequence determination system 140 enables providing a service for improving the efficiency of steel plate processing. For example, an engineer implements the sequence determination system 140 in a steel plant (S2200). As described above, the sequence determination system 140 includes the classifying section 800, the rough-scheduling section 810, the judging section 820, the detail-scheduling section 830, the local searching section 840 and the outputting section 850. Then, the engineer changes various sequence constraints or an objective function for determining a processing sequence of processing operations in response to a request from a manager of the steel plant (S2210). In addition, in response to a request from the manager of the steel plant, the engineer changes the positional constraints for determining the position into which each steel plate is inserted when the steel plate is arranged in the processing sequence (S2220). These changes can be carried out by changing the contents stored in the problem storage unit 160.

By adjusting the sequence constraints or the like in response to the request of the manager of the steel plant in the foregoing way, the sequence determination system 140 can be customized to the needs of various customers, thereby improving the processing efficiency.

Hereinabove, the present invention has been described by using the embodiment. However, the technical scope of the present invention is not limited to the above-described embodiment. It will be apparent to one skilled in the art that various modifications and improvements may be made to the embodiment. For example, the sequence determination system 140 according to this embodiment is capable of determining an appropriate processing sequence not only for steel plates but also for other types of products in order to enhance the processing efficiency. It is also apparent from the scope of claims of the present invention that thus modified and improved embodiments are included in the technical scope of the present invention.

What is claimed is:

1. A system for determining a processing sequence for delivering steel plates to work rolls of steel plate processing equipment, comprising:

a constraint storage unit for storing positional constraints that define ranges of positions into which each type of steel plate is to be inserted when the steel plates are arranged in the processing sequence;

a processing device and a selecting unit for execution by the processing device for preferentially selecting, as a position into which a new steel plate is to be inserted in an array of steel plates already arranged in the processing sequence, a position having a larger expectation value of the number of steel plates that can be further inserted into the array of steel plates after the insertion of the new steel plate while satisfying the positional constraints; and an inserting unit for inserting the new steel plate into the selected position in the processing sequence for delivery to the work rolls and for outputting data indicating the array of steel plates after the insertion.

2. The system according to claim 1, wherein the constraint storage unit stores, as the positional constraints, upper limit values determined for each type of steel plates and defining a last position in the processing sequence of arranging the type of steel plates, and;

the selecting unit includes:

a generating section for generating a plurality of candidate arrays of steel plates representing candidates for the array of steel plates after the insertion, by inserting the new steel plate into each of positions before the upper limit value of the type of the new steel plate in the array of steel plates already arranged in the processing sequence;

a first computing section which selects the steel plate arranged in the last position of each type of steel plates from each of the candidate arrays of steel plates, and which then computes an expectation value of the number of steel plates insertable into each of segments partitioned by the selected steel plates, on the basis of the difference value between the position of the selected steel plate and the upper limit value of the type of the selected steel plate; and a selection processing section for selecting, as the position into which the new steel plate is to be inserted, a position having the new steel plate inserted in order to generate the candidate array of steel plates having a larger sum total of the expectation values each computed for each segment.

3. The system according to claim 2, further comprising a candidate storage unit for storing at least one of the type, the post-rolling thickness and the post-rolling width of each of a base number of steel plates predetermined as candidates to be processed, wherein the constraint storage unit stores a satisfaction probability that, when a new steel plate is inserted into a position randomly selected from an array of steel plates already arranged in a processing sequence, the new steel plate satisfies the sequence constraint on at least one of the post-rolling thickness and the post-rolling width of the steel sheet, and with respect to each of the candidate arrays of steel plates generated by the generating section, the first computing section:

computes the difference value between the position of the steel plate serving as a boundary on the end-tail side in each of the segments, and the upper limit value corresponding to the steel plate;

computes a relaxed expectation value for each of the segments in a way that a value obtained by subtracting the number of steel plates in the array of the steel plates from the base number is multiplied by the satisfaction probability and the number of steel plates included in the segment, the relaxed expectation value being an expectation value of the number of steel plates insertable when the positional constraints are relaxed; and selects, as the expectation value of the number of insertable steel plates, a smaller value between the relaxed expectation value computed for the segment, and a value obtained by subtracting the sum total of the expectation values corresponding to the segments before the segment from the difference value of the segment.

4. The system according to claim 2, wherein the constraint storage unit further stores, as the positional constraints, lower limit values determined for each type of steel plates and defining a first position in the processing sequence of arranging the type of steel plates; and the generating section generates a plurality of arrays of steel plates representing candidates for the array of steel plates after the insertion, by inserting the new steel plate into each of a plurality of positions no matter what the lower limit value is, before the upper limit value of the type of the new steel plate, in the array of steel plates arranged in the processing sequence determined when the positional constraints on the lower limit value are relaxed, the selecting unit further includes a second computing section which selects a steel plate arrange in the first position of each type of steel plates from each of the generated candidate arrays of steel plates, and which computes an index value indicating the degree at which each of the arrays of steel plates violates the positional constraints on the lower limit value, on the basis of the difference value between the position of each of the selected steel plates and the lower limit value corresponding to the selected steel plate, and the selection processing section selects, as the position into which the new steel plate is to be inserted, a position having the new steel plate inserted in order to generate the array of steel plates having a smaller index value.

5. The system according to claim 4, further comprising a candidate storage unit for storing at least one of the type, the post-rolling thickness and the post-rolling width of each of a base number of steel plates predetermined as candidates to be processed, wherein the constraint storage unit stores a satisfaction probability that, when a new steel plate is inserted into a position randomly selected from an array of steel plates already arranged in a processing sequence, the new steel plate satisfies the sequence constraint on at least one of the post-rolling thickness and the post-rolling width of the steel sheet, and with respect to each of the candidate arrays of steel plates generated by the generating section, the second computing section:

selects a steel plate arranged in the first position of each type of steel plates in the array, computes an expectation value of the number of steel plates to be inserted before each of the selected steel plates in a way that a value obtained by subtracting the number of steel plates in the array from the base number is multiplied by the satisfaction probability and the number of steel plates before the selected steel plate in the array, and computes the index value by summing up the difference values which are obtained for types of steel plate each having the first steel plate whose position does not reach the lower limit value even when the expectation value is added thereto, and which are each obtained between a value obtained by adding the position of the first steel plate to the expectation value, and the lower limit value corresponding to the type of steel plate.

6. The system according to claim 4, further comprising a third computing section for computing a first estimated value indicating the efficiency of steel plate processing, wherein the selecting unit computes a second estimated value which takes a larger value as the first estimated value is larger, which takes a larger value as the expectation value is larger and which takes a larger value as the index value is smaller, and then selects a position that maximizes the second estimated value.

7. The system according to claim 1, further comprising a candidate storage unit for storing a type of each of a base number of steel plates predetermined as candidates to be processed, wherein the selecting unit repeats the process of selecting a position into which a steel plate not having a determined position in the processing sequence is to be inserted, for all the steel plates each not having a determined position in the processing sequence, among the base number of steel plates.

8. The system according to claim 1, further comprising a classifying section, a rough-scheduling section, a judging section and a detail-scheduling section, wherein a first sequence constraint based on a first attribute of each processing operation and a second sequence constraint based on a second attribute of each processing operation are defined between each pair of a plurality of processing operations of sequentially processing a plurality of steel plates, the classifying section classifies the plurality of processing operations into a plurality of clusters according to attribute values of the first attribute, and arranges the processing operations included in each of the clusters in a sequence satisfying the second sequence constraint, the rough-scheduling section regards the first sequence constraint as a sequence constraint between the plurality of clusters, and arranges the plurality of clusters in a sequence maximizing the efficiency of steel plate processing, the judging section judges whether or not the second sequence constraint is satisfied between the last processing operation in the array of a first cluster and the first processing operation in the array of a second cluster arranged next to the first cluster, and on condition that the second sequence constraint is not satisfied, the detail-scheduling section searches out another processing operation satisfying the second sequence constraint with each of the last processing operation in the array of the first cluster and with the first processing operation in the array of the second cluster, and arranges the searched-out processing operation next to the first cluster and before the second cluster, and the selecting unit selects a position into which the new steel plate is to be inserted in the array of steel plates indicating the processing sequence arranged by the detail-scheduling section.

9. The system according to claim 8, wherein the processing operation is a process of rolling a steel plate through a set of work rolls, the rough-scheduling section determines which cluster of processing operations to be performed in each of a plurality of blocks by solving an integer programming problem, the blocks obtained by dividing a period from a time of starting to roll a steel plate through the work rolls, to a time of exchanging the work rolls with new ones after sequentially rolling a plurality of steel plates, and the integer programming problem includes, a variable holding a state value for each block and for each cluster, the state value indicating whether or not the processing operations included in each of the clusters are performed, the first sequence constraint in which, a range of the number of clusters each including processing operations with each of the attribute values of the first attribute to be assigned to each block according to the attribute value, is expressed as a linear inequality of the variable, and an objective function for computing, with use of the value of the variable, an index value indicating the efficiency of steel plate processing.

10. A computer-implemented method of determining a processing sequence for delivering steel plates to work rolls of steel plate processing equipment, comprising the steps of:

a computer storage device storing positional constraints that define ranges of positions into which each type of steel plate is to be inserted when the steel plates are arranged in the processing sequence;

a computer processing device preferentially selecting, as a position into which a new steel plate is to be inserted in an array of steel plates already arranged in the processing sequence, a position having a larger expectation value of the number of steel plates that can be further inserted into the array of steel plates after the insertion of the new steel plate while satisfying the positional constraints provided by said computer storage device, and inserting the new steel plate into the selected position in the processing sequence for delivery to the work rolls and outputting data indicating the array of steel plates after the insertion.

11. A program stored at a program storage device for allowing an information processing apparatus to function as a system for determining a processing sequence for delivering steel plates to work rolls of steel plate processing equipment, the program causing the information processing apparatus to function as a constraint storage unit for storing positional constraints that define ranges of positions into which each type of steel plate is to be inserted when the steel plates are arranged in the processing sequence;

a selecting unit for preferentially selecting, as a position into which a new steel plate is to be inserted in an array of steel plates already arranged in the processing sequence, a position having a larger expectation value of the number of steel plates that can be further inserted into the array of steel plates after the insertion of the new steel plate while satisfying the positional constraints provided by the constraint storage unit; and an inserting unit for inserting the new steel plate into the selected position in the processing sequence for delivery to the work rolls and for outputting data indicating the array of steel plates after the insertion.

12. A method of providing a service of determining a processing sequence for delivering steel plates to work rolls of steel plate processing equipment, comprising the method of:

implementing a system including a constraint storage unit for storing positional constraints that define ranges of positions into which each type of steel plate is to be inserted when the steel plates are arranged in the processing sequence, a processing device and a selecting unit for execution by the processing device for preferentially selecting, as a position into which a new steel plate is to be inserted in an array of steel plates already arranged in the processing sequence, a position having a larger expectation value of the number of steel plates that can be further inserted into the array of steel plates after the insertion of the new steel plate while satisfying the positional constraints provided by the constraint storage unit, and an inserting unit for inserting the new steel plate into the selected position in the processing sequence for delivery to the work rolls and for outputting data indicating the array of steel plates after the insertion; and modifying the positional constraints in the implemented system.

* * * * *